US011136688B1

(12) United States Patent
Yang et al.

(10) Patent No.: US 11,136,688 B1
(45) Date of Patent: Oct. 5, 2021

(54) USE OF ELECTROPOLISHING FOR UNIFORM SURFACE TREATMENT OF METAL COMPONENTS WITH COMPLEX EXTERNAL GEOMETRIES

(71) Applicant: University of Louisville Research Foundation, Inc., Louisville, KY (US)

(72) Inventors: Li Yang, Crestwood, KY (US); Yan Wu, Louisville, KY (US); Christopher O'Neil, Louisville, KY (US); Austin Lassell, Georgetown, KY (US); Hengfeng Gu, South Jordan, UT (US)

(73) Assignee: University of Louisville Research Foundation, Inc., Louisville, KY (US)

( * ) Notice: Subject to any disclaimer, the term of this patent is extended or adjusted under 35 U.S.C. 154(b) by 105 days.

(21) Appl. No.: 16/536,164

(22) Filed: Aug. 8, 2019

Related U.S. Application Data

(60) Provisional application No. 62/716,018, filed on Aug. 8, 2018.

(51) Int. Cl.

| | |
|---|---|
| ***C25F 3/16*** | (2006.01) |
| ***C25F 7/00*** | (2006.01) |
| ***C25F 3/26*** | (2006.01) |

(52) U.S. Cl.
CPC ..... *C25F 3/16* (2013.01); *C25F 7/00* (2013.01); *C25F 3/26* (2013.01)

(58) Field of Classification Search
CPC ..... C25F 3/16; C25F 7/00
See application file for complete search history.

(56) References Cited

U.S. PATENT DOCUMENTS

| | | | |
|---|---|---|---|
| 4,851,090 | A | 7/1989 | Burns et al. |
| 6,413,388 | B1 | 7/2002 | Uzoh et al. |

(Continued)

FOREIGN PATENT DOCUMENTS

| | | | |
|---|---|---|---|
| CN | 101249577 | B | 1/2012 |
| CN | 107175376 | A | 9/2017 |
| CN | 107523856 | A | 12/2017 |

OTHER PUBLICATIONS

Chakradhar & Gopal (2011) Multi-objective optimization of electrochemical machining of EN31 steel by grey relational analysis. International Journal of Modeling and Optimization 1.2:113.

(Continued)

*Primary Examiner* — Brian W Cohen
(74) *Attorney, Agent, or Firm* — Jenkins. Wilson, Taylor & Hunt P.A.

(57) ABSTRACT

Systems and processes for treating surfaces of metal components are provided. The systems can include a container for containing a metal workpiece having a surface with a complex external geometry and for containing a solution that has electrolytes at a flow rate that varies according to a local shape of the surface to thereby treat the surface of the metal workpiece; optionally one or more electrodes for creating an electrical field; and optionally a temperature control device configured to provide a predetermined temperature or range of temperatures. The processes can include providing a metal workpiece having a surface with a complex external geometry; and contacting the workpiece in the presence of a predetermined electrical field at a predetermined temperature with a solution containing electrolytes at a flow rate that varies according to a local shape of the surface to thereby treat the surface of the metal workpiece.

11 Claims, 38 Drawing Sheets
(36 of 38 Drawing Sheet(s) Filed in Color)

(56) References Cited

U.S. PATENT DOCUMENTS

| | | | | |
|---|---|---|---|---|
| 8,252,167 | B2 * | 8/2012 | Kuriyama | C25D 17/008 205/148 |
| 8,470,160 | B2 * | 6/2013 | Luo | B23H 3/02 205/651 |
| 9,192,999 | B2 | 11/2015 | Carter et al. | |
| 9,782,829 | B2 | 10/2017 | Morris et al. | |
| 2009/0308760 | A1 * | 12/2009 | Wei | B23K 3/08 205/654 |
| 2010/0072077 | A1 | 3/2010 | Rohrbeck | |
| 2017/0175289 | A1 * | 6/2017 | Hung | C25F 7/00 |

OTHER PUBLICATIONS

Dehoff (2015) Evaluation of Electrochemical Machining Technology for Surface Improvements in Additive Manufactured Components. No. ORNL/TM-2015/384. Oak Ridge National Laboratory (ORNL), Oak Ridge, Tennessee, United States. Manufacturing Demonstration Facility (MDF).

* cited by examiner

Sample (20mmx5mmx1mm)

As-received sample surface ($R_a$ 30-40μm)

USE OF ELECTROPOLISHING FOR UNIFORM SURFACE TREATMENT OF METAL COMPONENTS WITH COMPLEX EXTERNAL GEOMETRIES

CROSS REFERENCE TO RELATED APPLICATIONS

This application claims the benefit of U.S. Provisional Patent Application Ser. No. 62/716,018, filed Aug. 8, 2018, the disclosure of which is incorporated herein by reference in its entirety.

GOVERNMENT INTEREST

This presently disclosed subject matter was made with government support under Grant No. #SC-2019-004, OGMB160057 awarded by the National Aeronautics and Space Administration (NASA) and Grant No. RID-3 #7800003125_OGMB160476 awarded by the National Science Foundation (NSF). The government has certain rights in the presently disclosed subject matter.

TECHNICAL FIELD

The presently disclosed subject matter relates primarily to the technology of electropolishing. In some embodiments, the presently disclosed subject matter relates to the use of electrochemical-based surface treatments for achieving uniform surface material removal and surface finish improvements for metal components with complex external geometries.

BACKGROUND

Surface quality has long been a significant issue for powder bed fusion additive manufacturing (PBF-AM) processes. In addition to the staircase effect which is intrinsic to most additive manufacturing (AM) processes, PBF-AM processes also faces an additional challenge. As the powder in fabrication area is melted, heat transfer occurs inevitably, which causes the powder adjacent to the fabricated area to be partially sintered and attached to the part surface. The surface sintering effect not only reduces the geometrical accuracy of the fabricated geometries, but also creates surface defects which could serve as crack initiation sites. For structures with large surface-to-volume ratios such as cellular structure or honeycomb structures, surface properties can sometimes dominate the overall performance of the structures, which further highlights the significance of the issue. On the other hand, fatigue performance is of importance to many applications in aerospace, automobile and bi-devices, which are widely regarded as the most promising targeting markets of AM technologies. Therefore, surface quality improvement of PBF-AM fabricated structures is of importance for the future adoption of the technologies.

Various efforts have been reported in the attempt to improve the surface qualities of PBF-AM parts. Surface quality of the PBF-AM parts are largely influenced by process parameters (1-3). In some works, active process control such as surface re-melting (2, 4, 5), selection of fine powder (6) and the use of optimized parameters (7, 8) have been utilized to improve the surface quality of the parts. However, due to the intrinsic characteristics of the process, these in-process surface quality control methods only achieve limited effects.

On the other hand, multiple post-process surface treatment methods have also been used to improve the geometrical accuracy of the final parts. Traditional surface treatment methods such as machining (9, 10), mechanical polishing (11), abrasive flow polishing (12), chemical milling (2, 13) and electroplating (11) have been investigated for their efficiency in treating AM fabricated parts, and they achieved mixed results. With most of the surface treatment processes, geometrical complexity of the treated parts is a significant challenge. For example, mechanical polishing and machining can be difficult to apply on undercut features and internal features, and abrasive flow polishing can usually only achieve desired surface finish on selected surfaces due to the directional flow of the abrasive fluid. Chemical milling and electroplating both rely on the mass transportation between a polishing fluid and the workpiece and therefore are both capable of accessing surfaces as long as they are external. Chemical milling is capable of removing surface materials at a wide range of controlled rate, and it also leaves minimum residuals on the treated surface as long as the stirring or mass transportation is sufficient. However, chemical milling often does not completely eliminate surface features due to the isotropic etching effect.

As shown in FIGS. 1A and 1B, after chemical milling, the surface bumps and extrudes of the thin lattice Ti6Al4V part made by electron beam melting (EBM) was reduced to small sharp-tip features instead of disappearing completely (13). As a result, the fatigue performance of such structures is only marginally improved and still considerably lower than that of the equivalent material with machined surfaces. On the other hand, the electroplating process is often used to alter the surface properties of a part by coating a thin layer of material on the part surface. Like anodizing processes, electroplating processes are based on both Faraday's Law and the laws of mass transportation. With Faraday's Law, the rate of electroplating reaction is influenced by the distance between the electrodes. Therefore, when setup properly, the extruded features on a surface are expected to have a higher electroplating rate compared to the other part of the surface, which could lead to higher reactant ion generate rate that could potential inhibit the electropolishing. As a result, electroplating can actually cause the increase the severity of the surface roughness if not controlled properly. To this end the electroplating process is typically not suitable for the improvement of surface finish of parts with complexity geometrical and surface conditions that are typical to PBF-AM.

Therefore, processes and systems for selective smoothing of surface features and the improvement of surface finish, particularly for complex surfaces, of AM parts represent an unmet and continuing need in the art.

SUMMARY

This summary lists several embodiments of the presently disclosed subject matter, and in many cases lists variations and permutations of these embodiments. This summary is merely exemplary of the numerous and varied embodiments. Mention of one or more representative features of a given embodiment is likewise exemplary. Such an embodiment can typically exist with or without the feature(s) mentioned; likewise, those features can be applied to other embodiments of the presently disclosed subject matter, whether listed in this summary or not. To avoid excessive repetition, this Summary does not list or suggest all possible combinations of such features.

In some embodiments, the presently disclosed subject matter relates to processes for treating surfaces of metal workpieces. In some embodiments, the methods comprise providing a metal workpiece having a surface comprising a complex external geometry; and contacting the workpiece in the presence of a predetermined electrical field at a predetermined temperature with a solution comprising electrolytes at a flow rate that varies according to a local shape of the surface to thereby treat the surface of the metal workpiece. In some embodiments, the temperature can be adjusted over a course of treatment or wherein the temperature is maintained substantially constant over a course of treatment. In some embodiments, a voltage of the electrical field is controlled by a DC power supply.

In some embodiments, the methods comprise providing the electrical field through a predetermined placement of a cathode and an anode, wherein the workpiece serves as the anode.

In some embodiments, the methods comprise adjusting a location and/or rotational angle of the cathode and the anode.

In some embodiments, the methods comprise adjusting a location and/or rotational angle of the cathode and/or the anode through a linear and/or rotational motion control mechanism.

In some embodiments, the linear and/or rotational motion control mechanism comprises a stepper motor or a gear motor.

In some embodiments, electrolyte flow circulation is controlled by a liquid pump system.

In some embodiments, the methods comprise comprising initially conducting a fluid flow simulation analysis for the workpiece whereby surface flow rate characteristics of the samples under different levels of overall electrolyte flow rates are estimated.

In some embodiments, the methods comprise comprising varying a location and/or a rotational angle of the workpiece numerous times or continuously during the process.

In some embodiments, the metal workpiece is produced by an advanced manufacturing technique.

In some embodiments, the presently disclosed subject matter also relates to systems for treating surfaces of metal workpieces. In some embodiments, the systems comprise a container for containing a metal workpiece having a surface comprising a complex external geometry and for containing a solution comprising electrolytes at a flow rate that varies according to a local shape of the surface to thereby treat the surface of the metal workpiece; one or more electrodes for creating an electrical field; and a temperature control device configured to provide a predetermined temperature or range of temperatures. In some embodiments, the container comprises a predetermined shape that directs flow of the electrolyte solution to the surface. In some embodiments, the container is configured to adjustably contain the workpiece such that a location and/or a rotational angle of the workpiece in the container can be adjusted.

In some embodiments, the presently disclosed systems comprise a DC power supply, wherein a voltage of the electrical field is controlled by the DC power supply.

In some embodiments, the one or more electrodes comprises a cathode and an anode and the electrical field is provided through a predetermined placement of the cathode and the anode, wherein the workpiece serves as the anode.

In some embodiments, a location and/or a rotational angle of the cathode and/or the anode are configured for linear and/or rotational motion control such that a location and/or a rotational angle of the cathode and the anode can be adjusted.

In some embodiments, the presently disclosed systems comprise a stepper motor or a gear motor, wherein stepper motor or the gear motor provide for linear and/or rotational motion control of the cathode and/or the anode.

In some embodiments, the temperature control device is configured so that the temperature can be adjusted over a course of treatment or wherein the temperature is maintained substantially constant over a course of treatment.

In some embodiments, the presently disclosed systems comprise a liquid pump system, wherein electrolyte flow circulation is controlled by the liquid pump system.

In some embodiments, the presently disclosed systems comprise a processor for initially conducting a fluid flow simulation analysis for the workpiece, whereby surface flow rate characteristics of the workpiece under different levels of overall electrolyte flow rates are estimated.

Accordingly, it is an object of the presently disclosed subject matter to provide processes and systems for electrochemical-based surface treatments of metal components. This and other objects are achieved in whole or in part by the presently disclosed subject matter. Further, an object of the presently disclosed subject matter having been stated above, other objects and advantages of the presently disclosed subject matter will become apparent to those skilled in the art after a study of the following description, Figures, and Examples. Additionally, various aspects and embodiments of the presently disclosed subject matter are described in further detail below.

BRIEF DESCRIPTION OF THE FIGURES

The patent or application file contains at least one drawing executed in color. Copies of this patent or patent application publication with color drawings will be provided by the United States Patent and Trademark Office upon request and payment of the necessary fee.

FIG. 1A shows the original Ti6Al4V thin feature and FIG. 1B shows the Ti6Al4V thin feature after 180 seconds of etching.

FIG. 7 illustrates the flow streamline of an electrolyte container design with regular cuboid shape (Same example as FIG. 2); FIG. 8 illustrates the flow streamline of an electrolyte container design with elongated cuboid shape, FIG. 9 illustrates the flow streamline of an electrolyte container design with curved-wall (same example as FIG. 4), and FIG. 10 illustrates the flow streamline of an electrolyte container design with curved-wall and curved-bottom. The four designs introduce different local electrolyte flow patterns on both the front and the back sides of the polished specimens.

FIG. 11A-11B illustrates the surface roughness reduction of different measurement lines at various locations of the polished specimen. The surface roughness reduction rate across the different parts of the surface exhibits differences when different electropolishing parameter settings are adopted. For example, in comparison, the 60V polishing voltage results in higher uniformity of surface roughness reduction but lower overall polishing rate. FIG. 11C-11D illustrates the standard deviation of the surface roughness reduction of different measurement lines at various locations of the polished specimen. Similarly, different electropolishing parameter settings result in different surface roughness reduction variability across the specimen. For example, the electropolishing voltage of 60V and 5 mm electrode spacing results in lower surface roughness reduction variability across the specimen surfaces, which could be desirable for uniform surface roughness reduction.

FIG. 21, 1,200 mL/m flow rate—no split) and without a splitter (FIG. 22, 800 mL/m flow rate—split; FIG. 23, 1,200 mL/m flow rate—no split), 7 mm electrode spacing (top view).

FIGS. 26 and 27, 1,200 mL/m flow rate).

DETAILED DESCRIPTION

Figure 1A:
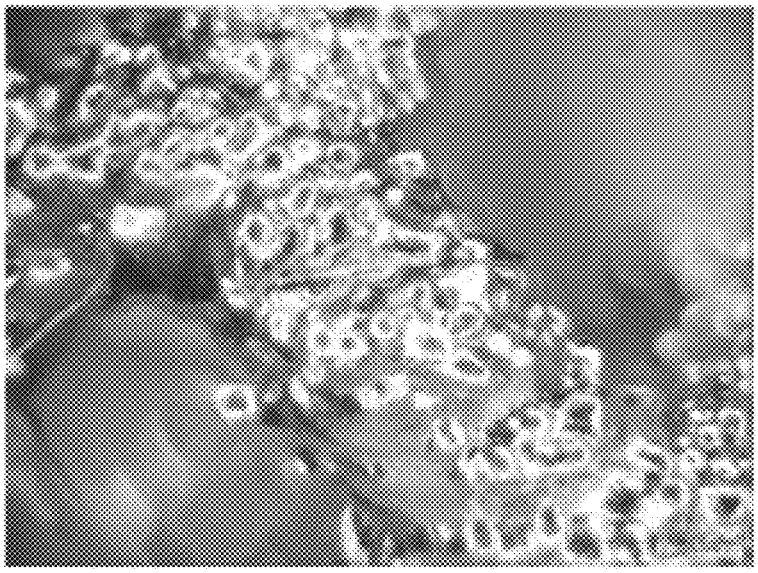
FIGS. 1A and 1B are photographs showing the effect of a prior art chemical milling technique on Ti6Al4V thin feature (M. Samoya, et al., Mechanical properties of chemically milled titanium lattice structures. Graduate Student Symposium, North Carolina State University, 2009).
Figure 1B:
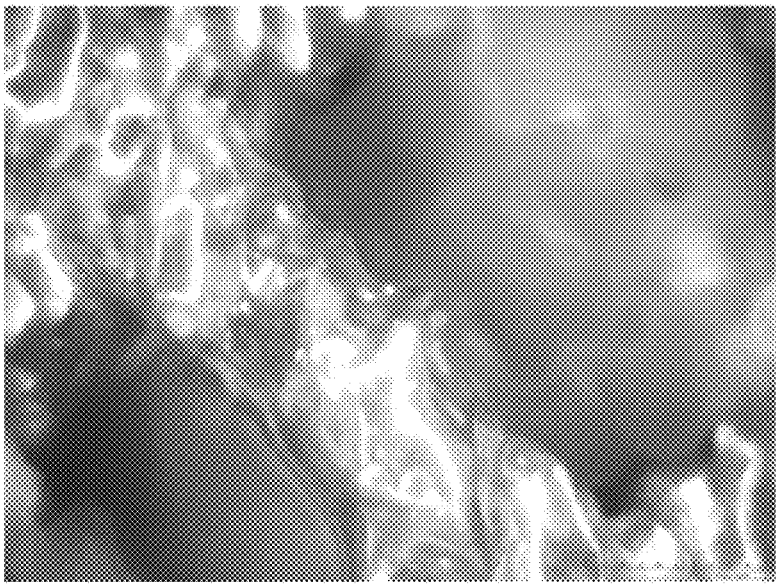

The presently disclosed subject matter relates in some embodiments to the use of electrochemical-based surface treatments for achieving uniform surface material removal and surface finish improvements for metal components with complex external geometries, usually produced by advanced manufacturing technologies such as additive manufacturing.

In representative, non-limiting Examples, the use of electropolishing in the surface treatment of Ti6Al4V metal parts made by powder bed fusion processes including direct metal laser sintering (DMLS) and electron beam melting (EBM) was investigated. A non-aqueous alcohol-based electrolyte was used, and the relationship between the process and surface roughness was evaluated. Based on the results, the feasibility of electropolishing as a post-surface treatment for additive manufactured metal parts was established.

I. General Considerations

Electropolishing is in principle the reverse of electroplating. The treated part is not connected as a cathode but as an anode, and when voltage is applied, the anode is polished by the removal of surface metal particles into electrolyte. Driven by electrical potential, the ionized particles from the treated workpiece will move towards the cathode enabled by the pathway provided by the electrolyte. Since the process is the reverse of electroplating, electropolishing is also driven by Faraday's Law, which means that the extruded features on the surface are selectively polished.

As the ion particles forms from the workpiece, they will need to be carried away sufficiently by the flow of the electrolyte. Thus, in establishing an electropolishing process and configuring an electropolishing system, consideration is given to the possible formation of a compact oxide layer at the newly polished surface. If the compact film could be readily dissolved by the electrolyte chemicals with the assist of electrical field, then the electropolishing process could continue with a characteristic equilibrium oxide layer on the surface of the anode that is sufficiently thin to allow for cations to diffuse. The thin oxide layer also prevents the etching effect when acidic solution is used since no selective chemical reaction at grain boundaries would take place. The higher viscosity and dissolution concentration at the valleys of the anode surface would eventually contribute to the smoothing effect of the electropolishing. There exists a threshold voltage potential for the breakdown of the oxide layer, which would result in significant gas generation and is usually avoided in the electropolishing process due to its tendency to deteriorate the polishing quality. Therefore, through careful adjustment of the process, electropolishing can effectively achieve selective smoothing of surface features and the improvement of surface finish. This feature, combined with the ability to access complex surfaces, enables the electropolishing as a desirable candidate for the surface treatment of AM parts.

In establishing an electropolishing process and configuring an electropolishing system, consideration is given to setting a voltage, such as a mildly high voltage, in order to sustain sufficient anode ionization while avoiding the onset of decomposition reaction of the oxide layer. Beside oxides, reaction products from the electropolishing process could also deposit on the workpiece surface under the effect of diffusion, which is sometimes undesired since it creates a barrier for mass transportation between the workpiece and the electrolyte and thus inhibit the electropolishing rate. Thus, in establishing an electropolishing process and configuring an electropolishing system, consideration is given to avoiding excessive oxide and precipitation layer formation on the workpiece surface through establishing a flow of electrolytes, such as by stirring, agitation or flow guiding of the electrolytes.

Further, in establishing an electropolishing process and configuring an electropolishing system, consideration is given to particular potential-current relationship(s) that contribute(s) towards desired electropolishing parameters. This relationship is impacted by the type of material and electrolyte used in the process. In a representative relationship, the current would increase approximately linearly at low potential levels until it reaches a threshold, after that there exists a plateau stage in which the current keeps more or less constant as the potential increases. At this stage, the electropolishing is dominated by mass transportation phenomenon. The ions diffuse through the surface layer at a stable rate, creating electropolishing current that is little dependent on the voltage level. When the potential is sufficiently high, the current will start to increase again in a more drastic rate, which is often referred to as chemical pitting. At this stage, significant breakdown of either the electrolyte or oxide layer could occur, and the resulting part surface is often affected by pitting effect.

Other factors such as temperature and water content in the electrolyte are also considered. Higher temperature could promote the mass transportation and therefore facilitate the polishing reaction; however, it could also cause unwanted decomposition reactions. On the other hand, water content in the electrolyte should also be controlled carefully according to the process needs, since it could facilitate the formation of the oxidation film of the surface.

Thus, the presently disclosed subject matter involves multiple aspects, including but not limited to: (1) the design of the treatment apparatus or system that can enable accurate control of various process variables such as solution temperature, electrical voltage, electrode spacing, and electrolyte flow rate; (2) the pre-processing analysis of the optimum manner of placement (e.g., orientation, location) of the samples in the electropolishing container in order to ensure uniform polishing rates; and (3) secondary subsystems or components in the treatment apparatus that can achieve accurate manipulation of the electrolyte flow field characteristics.

II. Processes and Systems

Provided in accordance with some embodiments of the presently disclosed subject matter is a process for treating a surface of a metal component or workpiece, such as a surface having a complex external geometry. In some embodiments, the method comprises providing a metal workpiece having a surface, such as a surface comprising a complex external geometry; and contacting the workpiece in the presence of a predetermined electrical field at a predetermined temperature with a solution comprising electrolytes at a flow rate that varies according to a local shape of the surface to thereby treat the surface of the metal component. In some embodiments, the metal component or workpiece is produced by an advanced manufacturing technique, examples of which are described elsewhere herein.

By "predetermined electrical field" it is meant to refer to an electrical field chosen based on the workpiece to be treated, including the material the workpiece comprises and the surface geometry of the workpiece. By way of example and not limitation, consideration is given to setting a voltage, such as a mildly high voltage, in order to sustain sufficient anode ionization while avoiding the onset of decomposition reaction of the oxide layer. Consideration is given to particular potential-current relationship(s) that contribute(s) towards desired electropolishing parameters. This relationship is impacted by the type of material and electrolyte used in the process. In a representative relationship, the current would increase approximately linearly at low potential levels until it reaches a threshold, after that there exists a plateau stage in which the current keeps more or less constant as the potential increases. At this stage, the electropolishing is dominated by mass transportation phenomenon. The ions diffuse through the surface layer at a stable rate, creating electropolishing current that is little dependent on the voltage level. When the potential is sufficiently high, the current will start to increase again in a more drastic rate, which is referred to as chemical pitting. At this stage, significant breakdown of either the electrolyte or oxide layer occurs, and the resulting part surface is often affected by pitting effect. Additional guidance for electric field parameters, such as but not limited to voltages and voltage ranges, can be found in the Examples and Figures discussed elsewhere herein. Typically, the desired electrical voltage should introduce relatively stable electropolishing rate that is less sensitive to the fluctuation of the voltage control, which corresponds to the plateau voltage range in the case that the oxide-film induced process occurs. In some embodiments, a voltage in the range of 50 to 150 volts is employed, including 50, 60, 70, 80, 90 and 100 volts. In some embodiments, a voltage of the electrical field is controlled by a DC power supply. In some embodiments, a voltage of the electrical field is controlled by a DC power supply with a waveform modulation function. In some embodiments, the voltage chosen provides a desired current or current density, such as but not limited to 0 to 5 A current and/or 6-8 kA/$m^2$ current density.

In some embodiments, the electrical field is provided through a predetermined placement of a cathode and an anode. Here as well, the placement of the cathode and anode is based on the workpiece to be treated, including the material the workpiece comprises and the surface geometry of the workpiece. In some embodiments, the workpiece acts as the anode. In some embodiments, the process comprises adjusting a location and/or rotational angle of the cathode and the anode relative to a flow of electrolytes. In some embodiments, adjusting a location and/or rotational angle of the cathode and/or the anode through a linear and/or rotational motion control mechanism. In some embodiments, the linear and/or rotational motion control mechanism comprises a stepper motor or a gear motor. In some embodiments, the rotational angle is varied by rotating the workpiece by a predetermined angle, such as but not limited to 90° during the course of treatment. In some embodiments, the time of treatment ranges for 1 minute to 30 minutes, including 1, 5, 10, 15, 20, 25, and 30 minutes. In some embodiments, the distance between electrodes ranges from 1 to 10 mm, including 1, 2, 3, 4, 5, 6, 7, 8, 9 and 10 mm. Adequate polishing time should be allowed for the electropolishing effect to be apparent. For example, apparent electropolishing effect might become apparent after 20 minutes of polishing.

By way of elaboration and not limitation, a sample that after electropolishing at 60V+5 mm+20 minutes setup, and the best surface finish at some area achieves Ra<100 nm, a significant reduction from the original value of such as Ra>20 μm. Robust correlations among the electric field (related to various parameters, such as voltage and distance), the electrolyte flow, and the polishing rate guide the design of process and system embodiments and the achievement of better control of the process and system for the reduction of the polishing rate variability.

Further, in establishing an electropolishing process and configuring an electropolishing system, consideration is given to avoiding excessive oxide and precipitation layer formation on the workpiece surface through establishing a flow of electrolytes, such as by flowing electrolytes over the workpiece. In some embodiments, flowing the electrolytes over the workpiece is controlled by a liquid pump system, such as but not limited to a peristaltic pump. Additional guidance for electrolyte flow parameters, such as but not limited to flow rates, ranges of flow rates, establishing laminar flow or other flow criteria, can be found in the Examples and Figures discussed elsewhere herein. In some embodiments, the flow rate ranges from 800 mL/minute to 1,200 mL/minute. In some embodiments, laminar flow is provided. In some embodiments, the electrolyte flow field can be fine-tuned via introducing variable-rate flow rate functions (e.g. sinusoidal flow rate), the use of specifically-designed electrolyte reaction container, and/or utilizing acoustic arrays and/or utilizing flow filters. For example, the use of electrolyte reaction container could potentially enhance the control of the flow rate of the electrolyte across a specimen with flat surface features. For another example, when non-differentiating electrolyte flow is desired, a flow filter with hole patterns could be implemented inside the inlet of the electrolyte reaction container to introduce turbulent flow across the entire specimen. For yet another example, an array of ultrasonic transducers could be installed on the sides of the electrolyte container walls, which will then introduce periodic vibration waveform of various patterns, such as sinusoidal, checkerboard or even more complex ones across the entire electrolyte fluid. Consequently, specific areas of the specimen surface achieve higher polishing rates, whereas other areas archive lower polishing rates.]

By "predetermined temperature" it is meant a temperature or temperature range chosen based on the workpiece to be treated, including the material the workpiece comprises and the surface geometry of the workpiece. By way of example and not limitation, a higher temperature, e.g. above room temperature, could promote the mass transportation and therefore facilitate the polishing reaction. However, the temperature or temperature range should not be so high as to cause unwanted decomposition reactions. In some embodiments, the temperature can be adjusted over a course of treatment. In some embodiments, the temperature is maintained substantially constant over a course of treatment. In some embodiments, the temperature ranges from 60° F. to 100° F., including 60° F., 70° F., 80° F., 90° F., and 100° F. For example, when the non-aqueous solution (700 mL ethanol, 300 mL isopropyl alcohol, 60 g aluminum chloride, 300 g zinc chloride) is used to electropolish the Ti6Al4V PBF-AM parts, a temperature window of 60° F.-100° F. can be selected. Lower temperature could potentially halt the electropolishing reaction, whereas higher temperature could potentially cause the decomposition of the chloride ingredients through accelerated exothermal electropolishing reaction.

In some embodiments, the process comprises initially conducting a fluid flow simulation analysis for the workpiece. In some embodiments, the fluid flow analysis comprises various fixing locations and/or rotational angles of the workpiece, whereby surface flow rate characteristics of the workpiece under different levels of overall electrolyte flow rates are estimated. In some embodiments, the workpiece fixing locations and/or rotational angles are adjusted to achieve a desired uniform overall surface flow rates across the exterior surface of the workpiece. In some embodiments, the rotational angle is varied by rotating the workpiece by a predetermined angle, such as but not limited to 90°, during the course of treatment. In some embodiments, the time of treatment ranges for 1 minute to 20 minutes, including 1, 5, 10, 15 and 20 minutes.

In some embodiments, during simulation, actual treatment, or both, dynamic workpiece-electrode orientation and/or electrode spacing can be adopted by varying the location and/or rotational angle of the samples numerous times or even continuously during the simulation, the surface treatment process, or both. In some embodiments, during simulation, actual treatment, or both, flow characteristics of the electrolyte can be further controlled and/or adjusted by implementing more advanced liquid flow control methods. Representative such techniques include but are not limited to use of the ultrasonic waveform generating transducer array, combined by continuous reorientating of the specimens during the polishing process, controlled by a motorized fixture. In some embodiments, the rotational angle is varied by rotating the workpiece by a predetermined angle, such as but not limited to 90° during the course of treatment. In some embodiments, the time of treatment ranges for 1 minute to 20 minutes, including 1, 5, 10, 15 and 20 minutes.

In some embodiments of the presently disclosed subject matter, an electropolishing system is provided. In some embodiments, the system configured to control one or process variables, such as solution temperature, electrical voltage, electrode spacing, and/or electrolyte flow rate. In some embodiments, a secondary subsystem in the system that achieves accurate manipulation of the electrolyte flow field characteristics is provided.

The solution temperature of the electrolyte can be adjusted by typical methods with target temperatures such as condenser heat exchanger or methods with to provide a temperature such as ice-water bath. The electrical voltage is typically controlled by a DC power supply with waveform modulation functions (e.g. capable of achieving step functions or sinusoidal functions with the DC voltage). The electrode spacing control is achieved by adjusting the locations and rotational angles of both the cathode and the anode (workpiece) through linear and rotational motion control mechanisms such as stepper motor or gear motor. The electrolyte flow circulation is controlled by typical liquid pump systems (e.g. peristaltic pump).

In some embodiments, for each new incoming sample or workpiece, fluid flow simulation analysis for the samples at various fixing locations and rotational angles are carried out, the surface flow rate characteristics of the samples under different levels of overall electrolyte flow rates are estimated. The sample fixing locations and rotational angles can be adjusted to achieve the most uniform overall surface flow rates across the exterior surfaces of the samples. Alternatively, dynamic sample-electrode orientation or electrode spacing can be adopted by varying the location and rotational angle of the samples/workpieces numerous times or even continuously during the surface treatment process.

Besides the controllability of location and rotational angles of the samples either continuously or intermittently, the flow characteristics of the electrolyte can be further controlled and adjusted by implementing more advanced liquid flow control methods. In addition to the overall flow rate control through the pump, the electrolyte flow field can be fine-tuned via introducing variable-rate flow rate functions (e.g. sinusoidal flow rate) or utilizing acoustic arrays.

Referring now to the Figures, wherein like reference numerals refer to like parts throughout, and referring particularly to FIGS. 2, 4, 6-11B, 12-15, 20-23, 29, and 47-50, a system for treating a surface of a metal component in accordance with the presently disclosed subject matter is referred to generally at 10. In some embodiments, system 10 comprises a container 12 for containing a metal workpiece 14. In some embodiments, workpiece 14 has a surface comprising a complex external geometry. Container 12 holds a solution 16 comprising electrolytes at a flow FL that varies according to a local shape of the surface to thereby treat the surface of the metal component. In some embodiments, flow FL enters container 12 at an inlet I and travels towards workpiece 14 and outlet O. System 10 comprises one or more electrodes 20 for creating an electrical field; and a temperature control device, such as a water or ice bath 22 and/or or heat exchanger 36 and/or thermocouple 52 are configured to provide a predetermined temperature or range of temperatures. The temperature can be adjusted over a course of treatment or can be maintained substantially constant over a course of treatment.

Continuing with reference to FIGS. 2, 4, 6-11B, 12-15, 20-23, 29 and 47-50, system 10 comprises a power supply 24, which can be a DC power supply, which can be a rectifier or other suitable power supply. In some embodiments, and a voltage of the electrical field is controlled by DC power supply 24. In some embodiments, DC power supply 24 can be programmed or controlled to provide power according to a waveform modulation function. In some embodiments, DC power supply 24 can be connected the cathode and anode via leads, such as leads 38 and 40 in FIG. 12B, or other suitable connector. System 10 can comprise a cathode and an anode. In some embodiments, the workpiece 14 constitutes the anode, and the electrical field is provided by the cathode 18 and the anode/workpiece 14. In some embodiments, the electrical field is provided through a predetermined placement of the cathode and the anode. In some embodiments, system 10 provides for the adjusting a location L and/or rotational angle AN (shown schematically in FIGS. 11A and 11B) of the cathode and the anode, optionally through linear and/or rotational motion control mechanisms such as but not limited to a stepper motor or a gear motor, referred to at 26 in FIG. 29, for example. In some embodiments, electrolyte flow circulation FL is controlled by a liquid pump system 30, such as but not limited to a peristaltic pump (see FIGS. 12A and 29). In some embodiments, a splitter 50 is included for the control of electrolyte flow. In some embodiments, when non-differentiating electrolyte flow is desired, a flow filter 56 with hole patterns could be implemented inside the inlet I of the electrolyte reaction container 12 to introduce turbulent flow across the entire specimen 14. See FIG. 50. In some embodiments, an array 54 of ultrasonic transducers is installed on the sides of the walls of electrolyte container 12, which will then introduce periodic vibration waveform of various patterns, such as sinusoidal, checkerboard or even more complex ones across the entire electrolyte fluid 16. See FIG. 48.

Continuing with reference to FIGS. 2, 4, 6-11B, 12-15, 20-23, 29 and 47-50, system 10 can further comprise a processor 44 configured and/or programmed for conducting a fluid flow simulation analysis for workpiece 14. Processor 44 can comprise a suitable programmed computer, tablet, smart phone or other devices necessary to realize either the flow control or the repositioning and reorienting of the specimens. In some embodiments, multiple sample locations are selected for flow rate simulation. See FIG. 49. In some embodiments, the fluid flow analysis, the treatment itself, or both comprises various fixing locations and/or rotational angles, whereby surface flow rate characteristics of the samples under different levels of overall electrolyte flow rates are estimated. In some embodiments, the workpiece fixing locations and/or rotational angles are adjusted to achieve a desired uniform overall surface flow rates across the exterior surface of the workpiece. In some embodiments, dynamic workpiece-electrode orientation and/or electrode spacing can be adopted by varying the location and/or rotational angle of the samples numerous times or even continuously during the simulation, the surface treatment process, or both. In some embodiments, flow characteristics of the electrolyte can be further controlled and/or adjusted by implementing more advanced liquid flow control methods. In some embodiments, the electrolyte flow field can be fine-tuned via introducing variable-rate flow rate functions (e.g. sinusoidal flow rate) and/or utilizing acoustic arrays, such as the use of the ultrasonic waveform generating transducer array, combined by continuous reorientating of the specimens during the polishing process, controlled by a motorized fixture. In some embodiments, a secondary subsystem in system that achieves accurate manipulation of the electrolyte flow field characteristics is provided.

In some embodiments, a non-aqueous electrolyte is employed in the methods and systems of the presently disclosed subject matter. In some embodiments, the electrolyte comprises ethanol, isopropyl alcohol, aluminum chloride and zinc chloride. In some embodiments, a 1 L solution of the electrolyte comprises 700 mL of ethanol, 300 mL of isopropyl alcohol, 60 g $AlCl_3$ and 250 g $ZnCl_2$. Any desired volume of electrode can be used, such as but not limited to about 100 mL of electrolyte, about 200 mL of electrolyte, about 300 mL of electrolyte, about 400 mL of electrolyte, or about roughly 500 mL of electrolyte. Depending on the types of materials, other electropolishing solutions can be considered. For example, when Ti6Al4V or nickel alloy is polished, other solutions such as hydrofluoric acid and perchloric acid.

Representative metals include Ti6Al4V and Inconel 718 (IN718). Metal workpieces can be fabricated via any suitable technique as would be apparent to one of ordinary skill in the art upon a review of the instant disclosure. Representative processes include electron beam melting additive manufacturing process and laser melting powder bed fusion. Typical starting surface finish is around mean roughness (Ra)=20-40 μm. The electropolishing achieved surface finish can be Ra<1 μm. Titanium alloys have been notoriously difficult to process with chemical and electrochemical methods. Due to the existence of the highly stable oxide thin film on the surface, traditionally only a few acids could effectively react with titanium alloys, including hydrofluoric acid and perchloric acid. These chemicals are highly hazardous and could cause serious accidents if not used with extreme care. Ti6Al4V is the most widely used material for EBM processes, which sees many potential applications in aerospace and biomedical industries. The surface finish of typical EBM parts ranges between Ra 20-30 μm. The surface finish of the top surface is usually slightly better, while the sides are usually rougher. Due to the use of relatively coarse powder compared to the laser based PBF-AM process and the larger size of the electron beam, the surface quality issue is more significant with the EBM process.

Metal workpieces to be treated can be any desired sized. By way of example and not limitation, metal workpieces can be plates with a flat surface area of 5 mm×20 mm The presently disclosed subject matter considers relationships between various process parameters (temperature, electrical voltage, electrode spacing, polishing time). The significance of the flow characteristic to the surface treatment is considered by evaluating the surface finish of samples under various circulation flow rate and container designs.

The process and system setup and guidelines are configured based on additional electrolyte flow simulations. Such simulations establish effective spacing and part orientation strategies that ensure uniform surface material removal rate and surface quality improvement by assessing possible geometry options of the parts and consequently possible flow characteristics.

Headings are included herein for reference and to aid in locating certain sections. These headings are not intended to limit the scope of the concepts described therein under, and these concepts may have applicability in other sections throughout the entire specification.

In describing and claiming the presently disclosed subject matter, the following terminology will be used in accordance with the definitions set forth below.

The terminology used herein is for the purpose of describing particular embodiments only and is not intended to be limiting of the presently disclosed subject matter.

In describing the presently disclosed subject matter, it will be understood that a number of techniques and steps are disclosed. Each of these has individual benefit and each can also be used in conjunction with one or more, or in some cases all, of the other disclosed techniques.

Accordingly, for the sake of clarity, this description will refrain from repeating every possible combination of the individual steps in an unnecessary fashion. Nevertheless, the specification and claims should be read with the understanding that such combinations are entirely within the scope of the presently disclosed subject matter and the claims.

All technical and scientific terms used herein, unless otherwise defined below, are intended to have the same meaning as commonly understood by one of ordinary skill in the art. References to techniques employed herein are intended to refer to the techniques as commonly understood in the art, including variations on those techniques or substitutions of equivalent techniques that would be apparent to one of skill in the art. While the following terms are believed to be well understood by one of ordinary skill in the art, the following definitions are set forth to facilitate explanation of the presently disclosed subject matter.

While the following terms are believed to be well understood by one of ordinary skill in the art, the following definitions are set forth to facilitate explanation of the presently disclosed subject matter.

As used herein and in the appended claims, the singular forms "a," "an," and "the" include plural referents unless the context clearly dictates otherwise. For example, a nucleic acid molecule refers to one or more nucleic acid molecules. As such, the terms "a", "an", "one or more" and "at least one" can be used interchangeably. Similarly, the terms "comprising", "including" and "having" can be used interchangeably. It is further noted that the claims may be drafted to exclude any optional element. As such, this statement is intended to serve as antecedent basis for use of such exclusive terminology as "solely," "only" and the like, in connection with the recitation of claim elements, or use of a "negative" limitation.

Ranges can be expressed herein as from "about" one particular value, and/or to "about" another particular value. When such a range is expressed, some embodiments includes from the one particular value and/or to the other particular value. Similarly, when values are expressed as approximations, by use of the antecedent "about," it will be understood that the particular value forms an embodiment.

It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that when a value is disclosed that "less than or equal to" the value, "greater than or equal to the value" and possible ranges between values are also disclosed, as appropriately understood by the skilled artisan. For example, if the value "10" is disclosed, then "less than or equal to 10" as well as "greater than or equal to 10" are also disclosed. It is also understood that the throughout the application, data are provided in a number of different formats, and that these data represent in some embodiments endpoints and starting points and in some embodiments ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

The term "and/or", when used in the context of a list of entities, refers to the entities being present singly or in combination.

The terms "optional" and "optionally" as used herein indicate that the subsequently described event, circumstance, element, and/or method step may or may not occur and/or be present, and that the description includes instances where said event, circumstance, element, or method step occurs and/or is present as well as instances where it does not.

EXAMPLES

Figure 2:
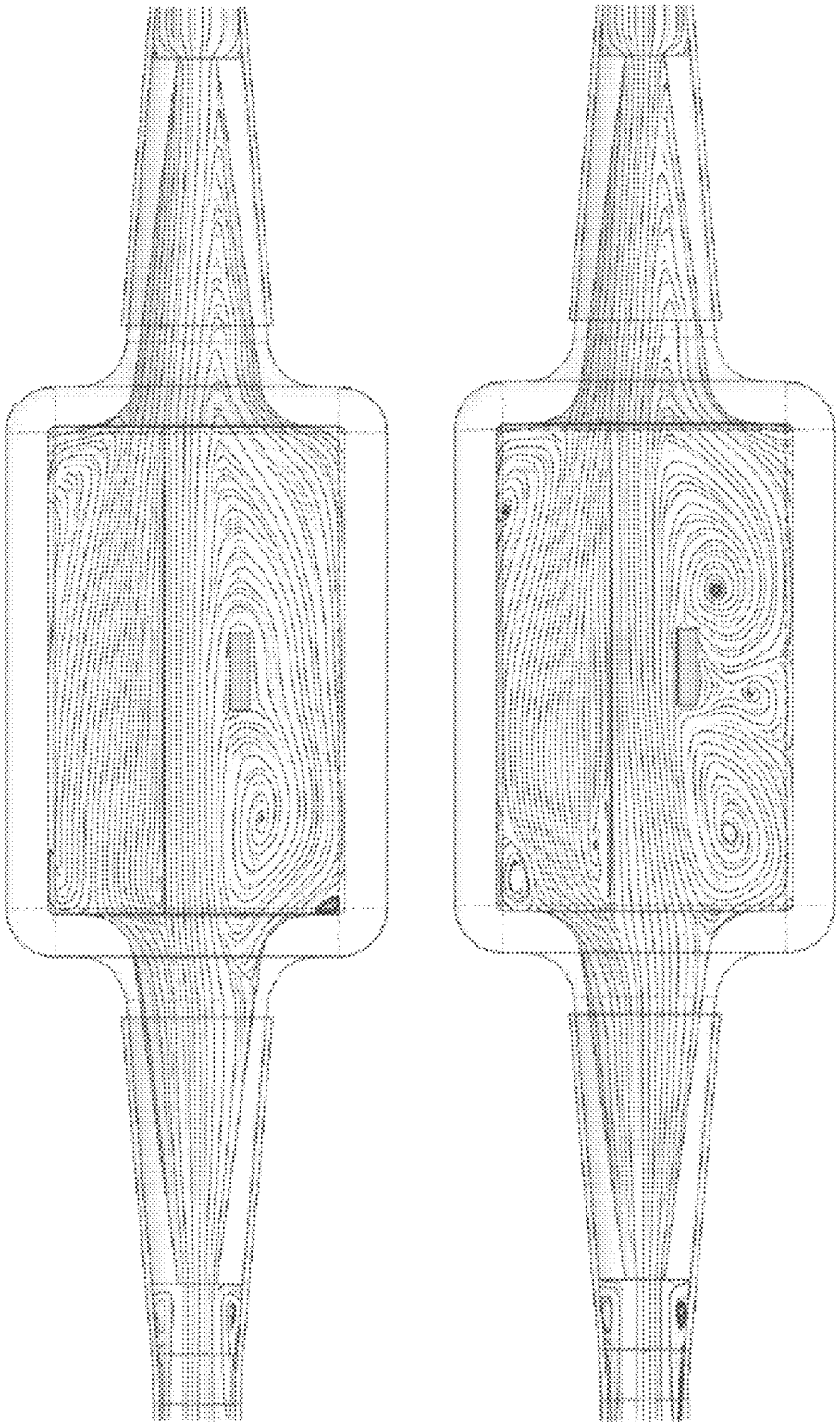
FIG. 2 is a set of schematic drawings illustrating electrolyte flow in a container (laminar radius tank) in accordance with the presently disclosed subject matter: left panel, 800 mL/minute and right panel, 1,200 mL/minute. The parallel streamlines between the anode and Inconel in each panel are indicative of laminar flow behavior. As clearly shown in the illustrations, with increased flow rate, the electrolyte flow streamlines exhibits more significant turbulent flow, especially on the back side of the specimen, which could be less desired when highly controlled specimen surface flow rate is desired.
Figure 3:
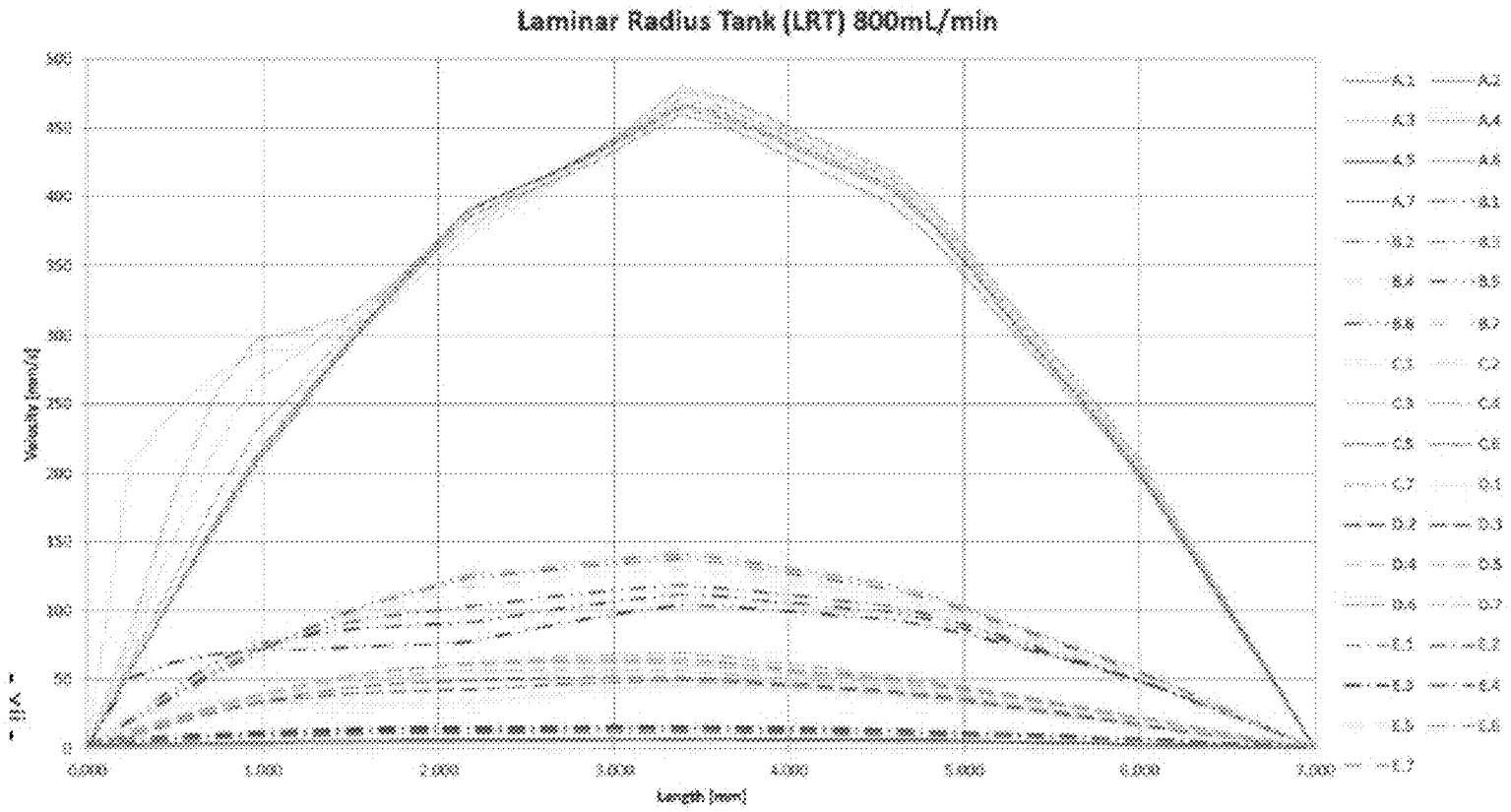
FIG. 3 is a plot of velocity versus length for the 800 mL/minute laminar radius tank (LRT) shown in the left panel of FIG. 4. Location index X.Y, in which X ranges from A through E and Y ranges from 1 through 7, indicates different locations of the flat specimen as illustrated in the additional figure attached, which shows that the even for a relatively simple surface type, there still exists differential location-specific electrolyte flow variability, which can be quantified and consequently utilized for electropolishing process control and adjustment.
Figure 4:
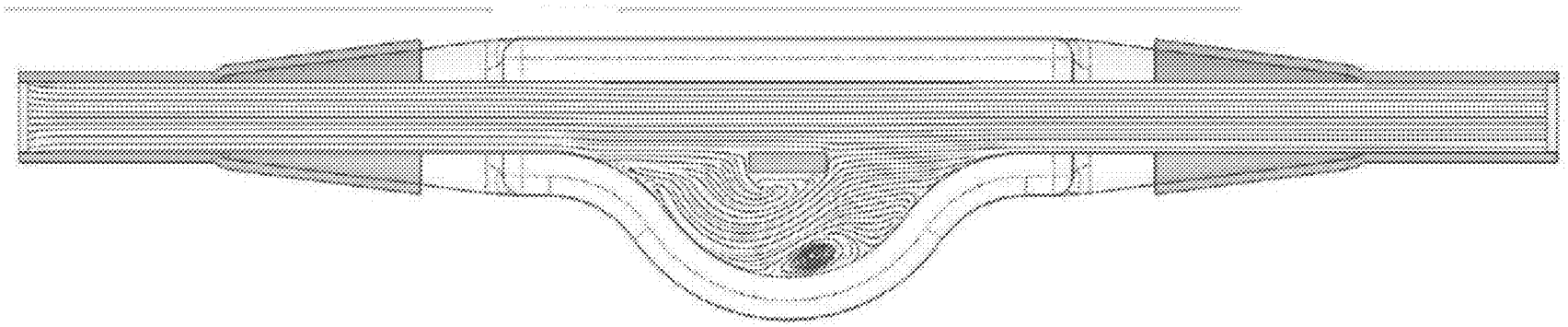
FIG. 4 is a schematic drawing illustrating electrolyte flow in a container (laminar radius tank) in accordance with the presently disclosed subject matter: 1,200 mL/minute. The introduction of the specific curved-wall electrolyte reaction tank improved the laminar flow uniformity on the front side of the specimen, while the flow on the back side of the specimen remains largely turbulent.
Figure 5:
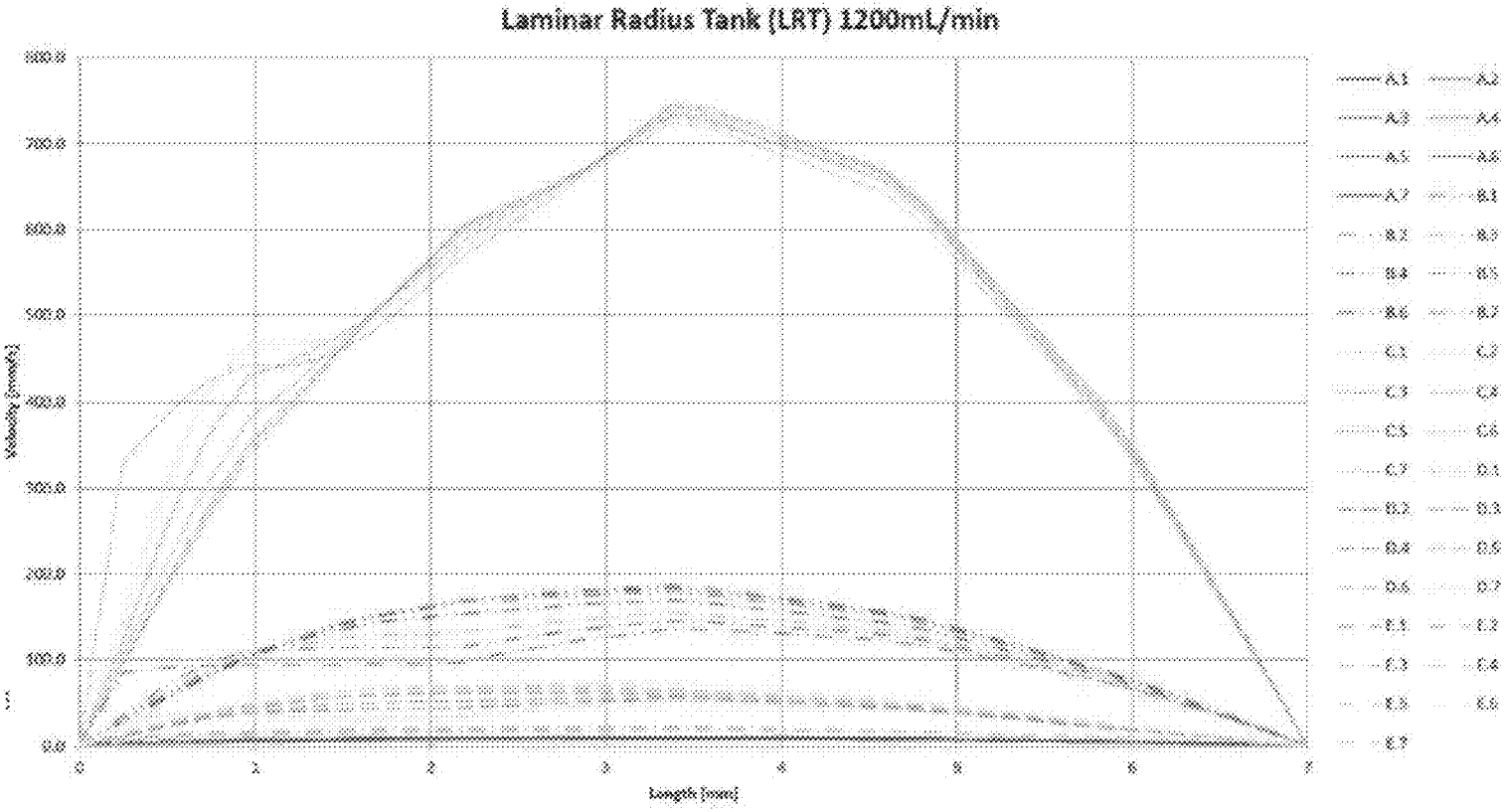
FIG. 5 is a plot of velocity versus length for the 1,200 mL/minute laminar radius tank (LRT) shown in FIG. 2. Location index X.Y, in which X ranges from A through E and Y ranges from 1 through 7, indicates different locations of the flat specimen as illustrated in the additional figure attached, which shows that the even for a relatively simple surface type, there still exists differential location-specific electrolyte flow variability, which can be quantified and consequently utilized for electropolishing process control and adjustment. Comparing FIG. 5 and FIG. 3, the curved-wall container also reduced the overall flow rate difference across different locations of the specimen, which demonstrates the potential effectiveness of introducing electrolyte flow regulation through container redesign, specific to the specimen shape and guided by the fluid simulation.
Figure 6:
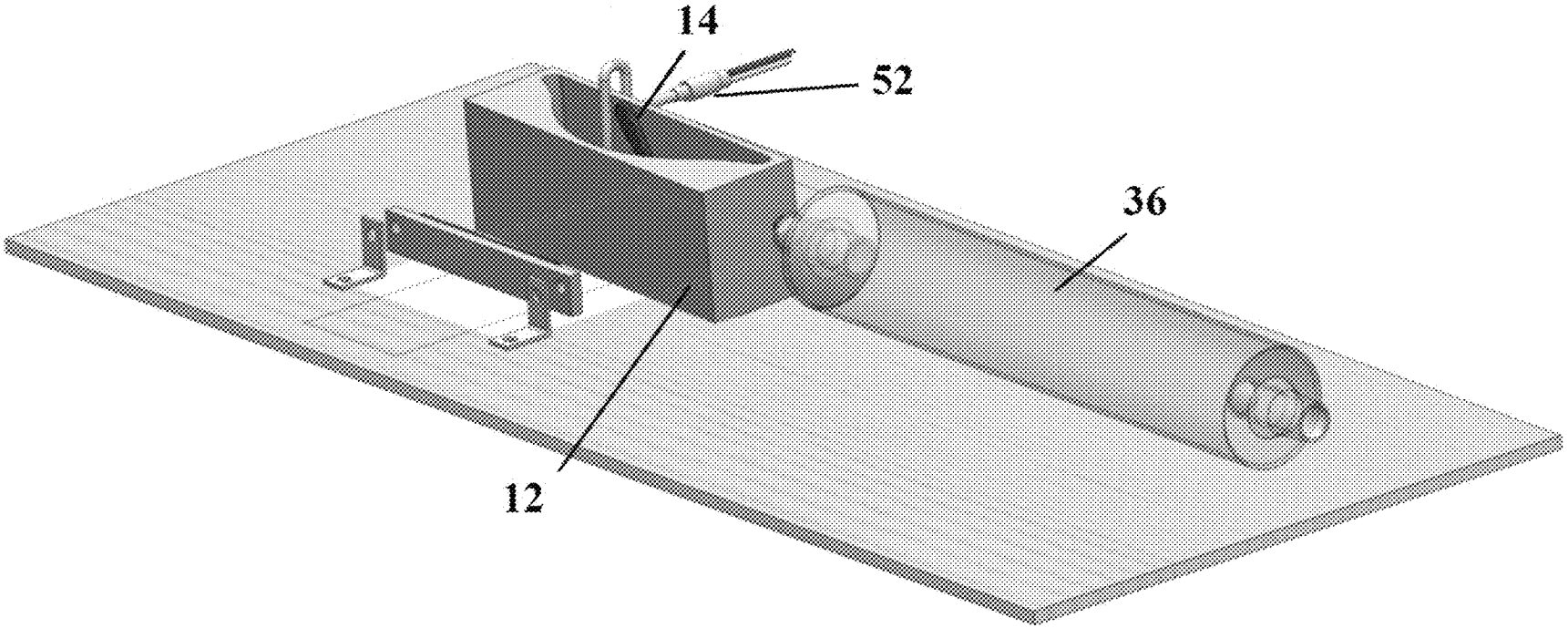
FIG. 6 is a schematic perspective view of a system for electropolishing. In the electropolishing system, both the electrolyte reaction container/tank shape and the sample orientation can be adjusted to achieve specific electrolyte flow control objectives, such as uniform flow rate, or differential flow rate of known quantities. Heat exchanger subsystem is utilized to introduce cooling or heating to the electrolyte in order to maintain temperature of the electrolyte, which is constantly monitored by the temperature sensor, such as a thermocouple.

FIG. 2 is a set of schematic drawings illustrating electrolyte flow in a container (laminar radius tank) in accordance with the presently disclosed subject matter: left panel, 800 mL/minute and right panel, 1,200 mL/minute. As clearly shown in the illustrations, with increased flow rate, the electrolyte flow streamlines exhibits more significant turbulent flow, especially on the back side of the specimen, which could be less desired when highly controlled specimen surface flow rate is desired. FIG. 3 is a plot of velocity versus length for the 800 mL/minute laminar radius tank (LRT) shown in the left panel of FIG. 2. Location index X.Y, in which X ranges from A through E and Y ranges from 1 through 7, indicates different locations of the flat specimen as illustrated in the additional figure attached, which shows that the even for a relatively simple surface type, there still exists differential location-specific electrolyte flow variability, which can be quantified and consequently utilized for electropolishing process control and adjustment. Comparing FIG. 5 and FIG. 3, the curved-wall container also reduced the overall flow rate difference across different locations of the specimen, which demonstrates the potential effectiveness of introducing electrolyte flow regulation through container redesign, specific to the specimen shape and guided by the fluid simulation. FIG. 4 is a schematic drawing illustrating electrolyte flow in a container (laminar radius tank) in accordance with the presently disclosed subject matter: 1,200 mL/minute. The introduction of the specific curved-wall electrolyte reaction tank improved the laminar flow uniformity on the front side of the specimen, while the flow on the back side of the specimen remains largely turbulent. FIG. 5 is a plot of velocity versus length for the 1,200 mL/minute laminar radius tank (LRT) shown in FIG. 4. Location index X.Y, in which X ranges from A through E and Y ranges from 1 through 7, indicates different locations of the flat specimen as illustrated in the additional figure attached, which shows that the even for a relatively simple surface type, there still exists differential location-specific electrolyte flow variability, which can be quantified and consequently utilized for electropolishing process control and adjustment.

Figure 7:
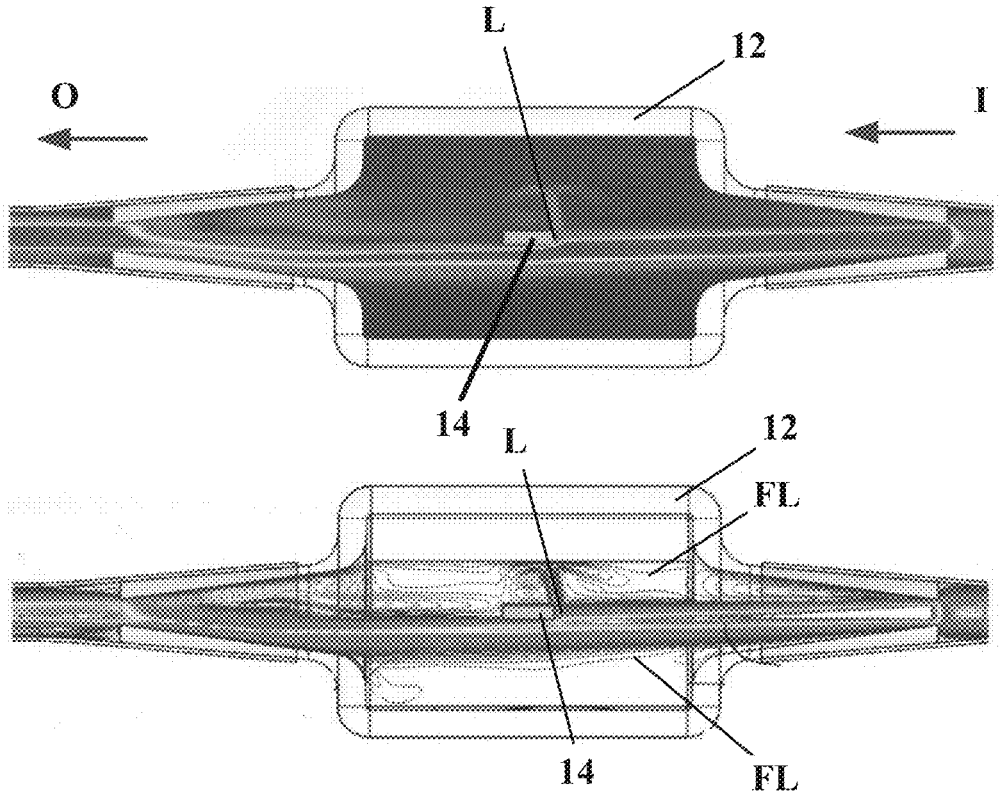
FIGS. 7-10 are schematic drawings illustrating electrolyte flow in various container configurations in accordance with the presently disclosed subject matter. The lower panel in FIG. 10 is a vertical cross-section taken along the line A-A in the upper panel in FIG. 10.
Figure 8:
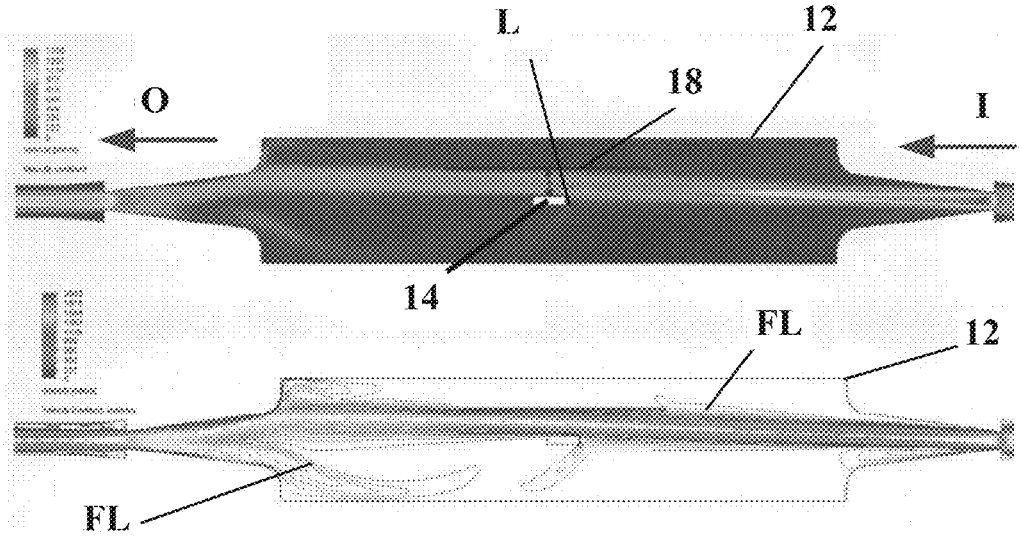
Figure 9:
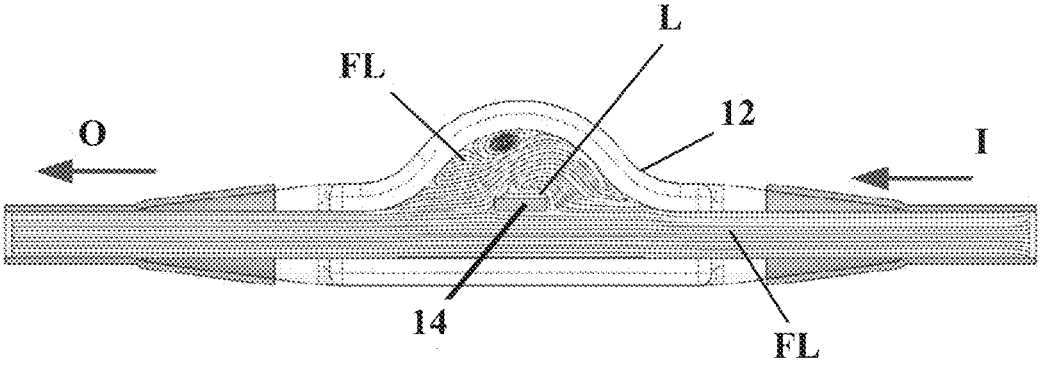
Figure 10:
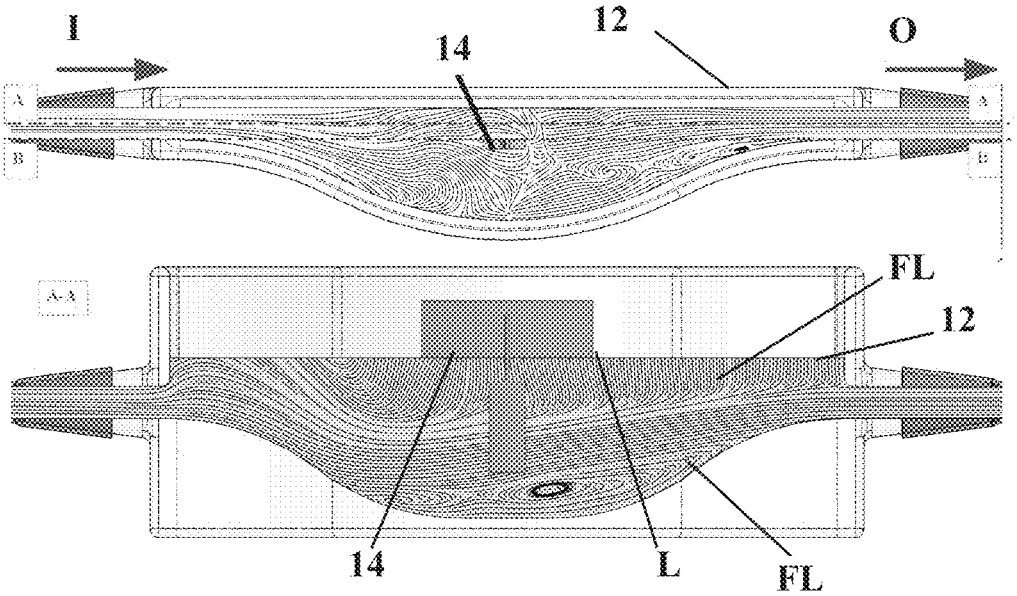
Figure 11A:
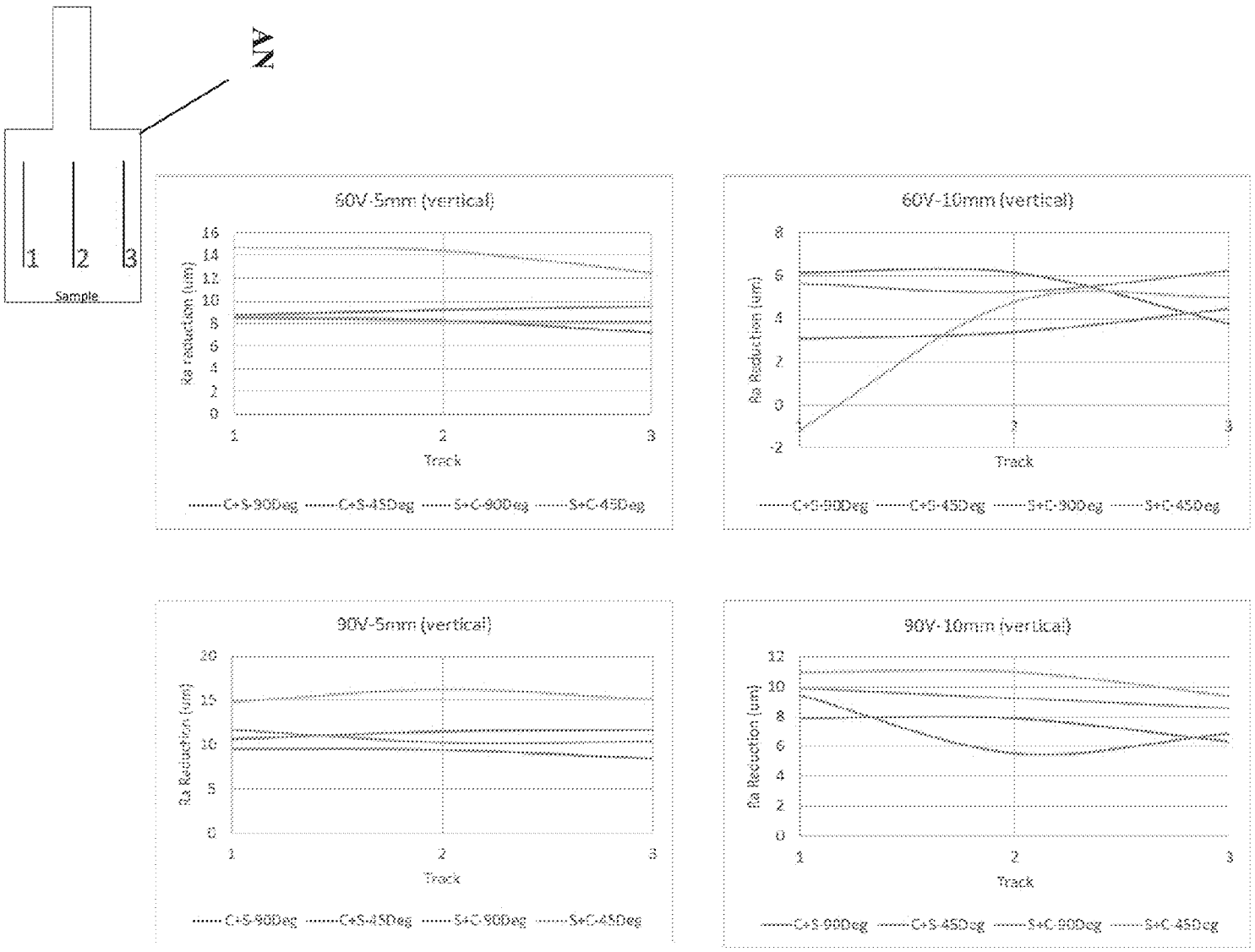
FIGS. 11A-11D are plots for various voltage/workpiece position/workpiece orientation configurations in accordance with the presently disclosed subject matter.
Figure 11B:
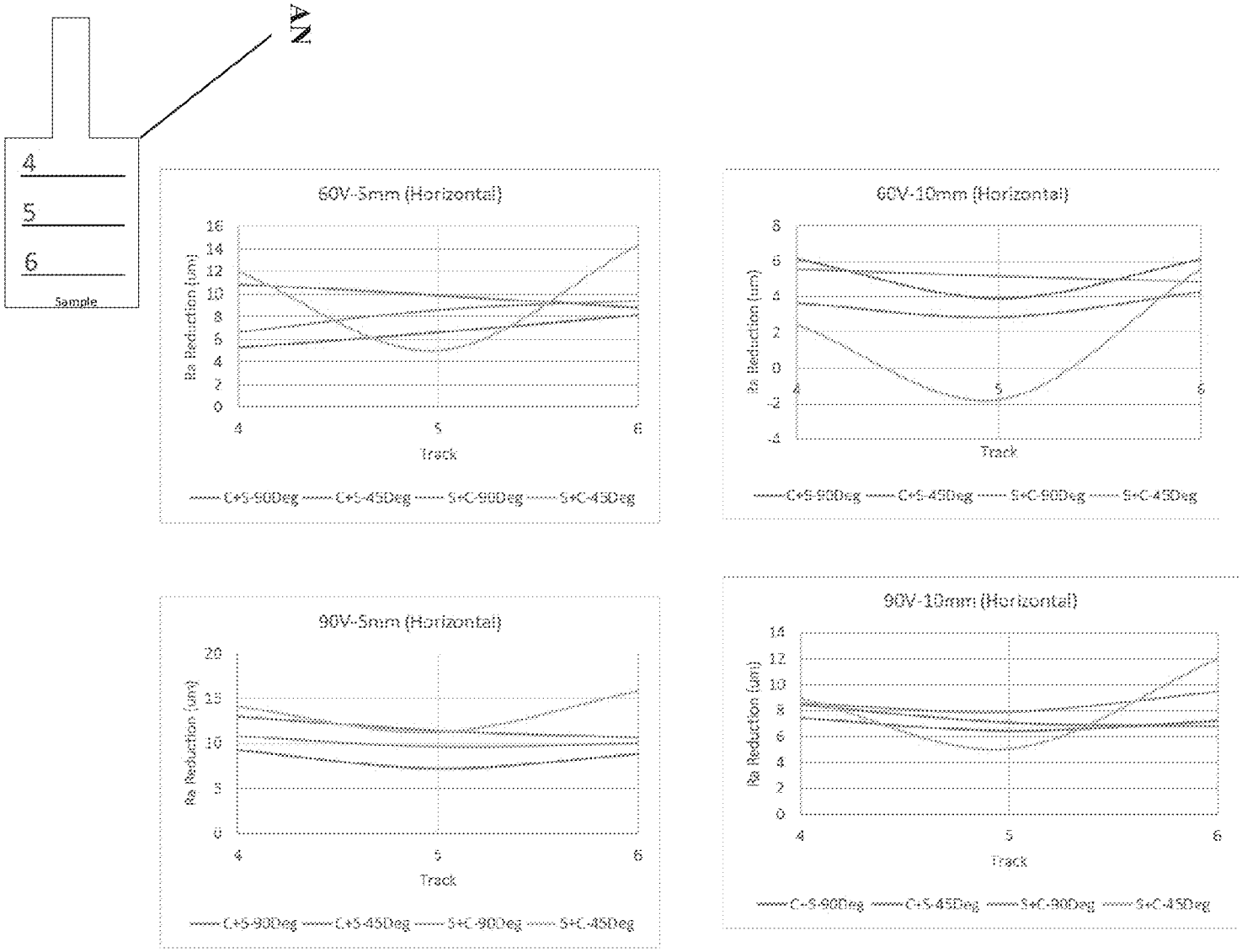
Figure 11C:
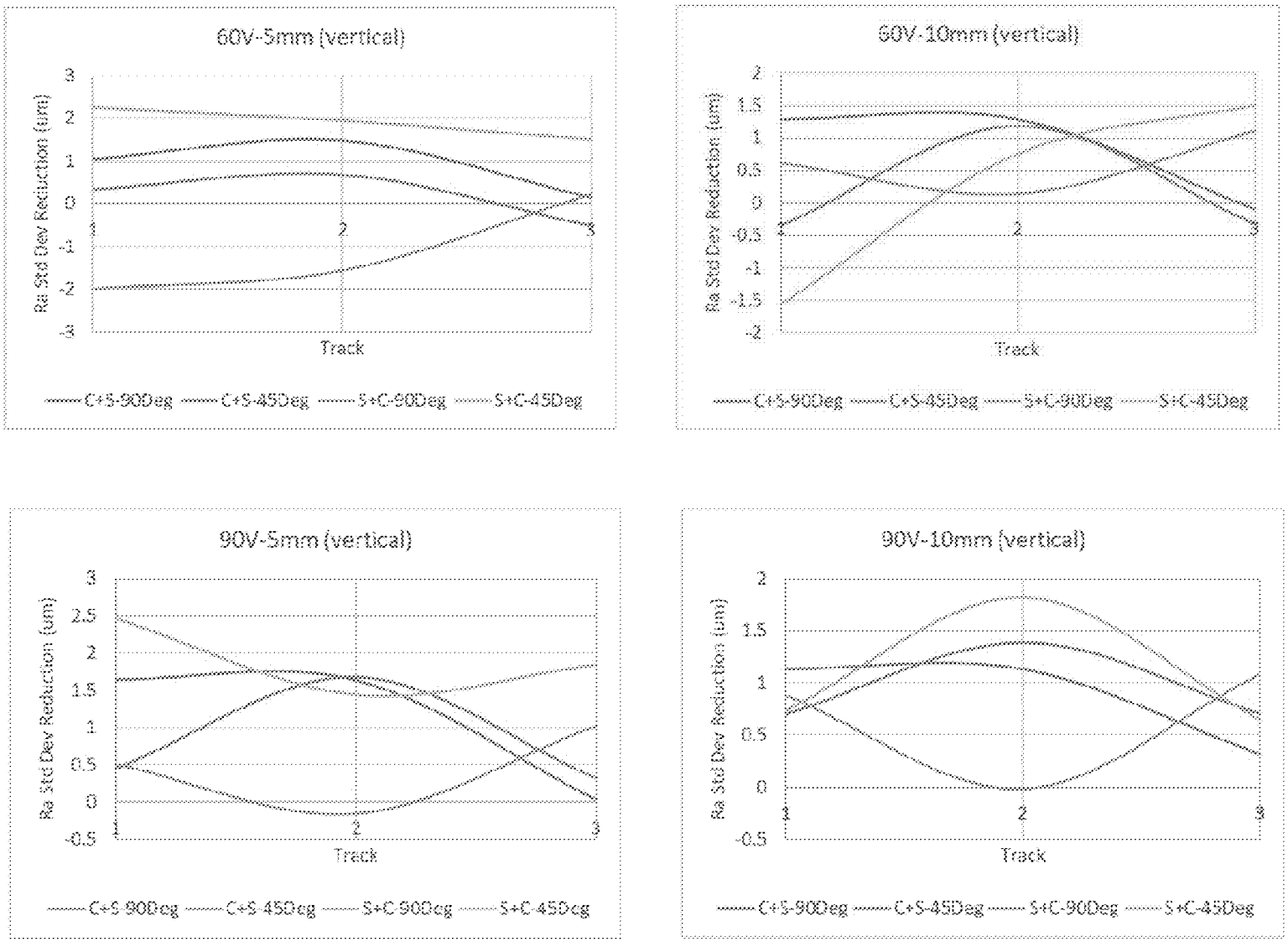
Figure 11D:
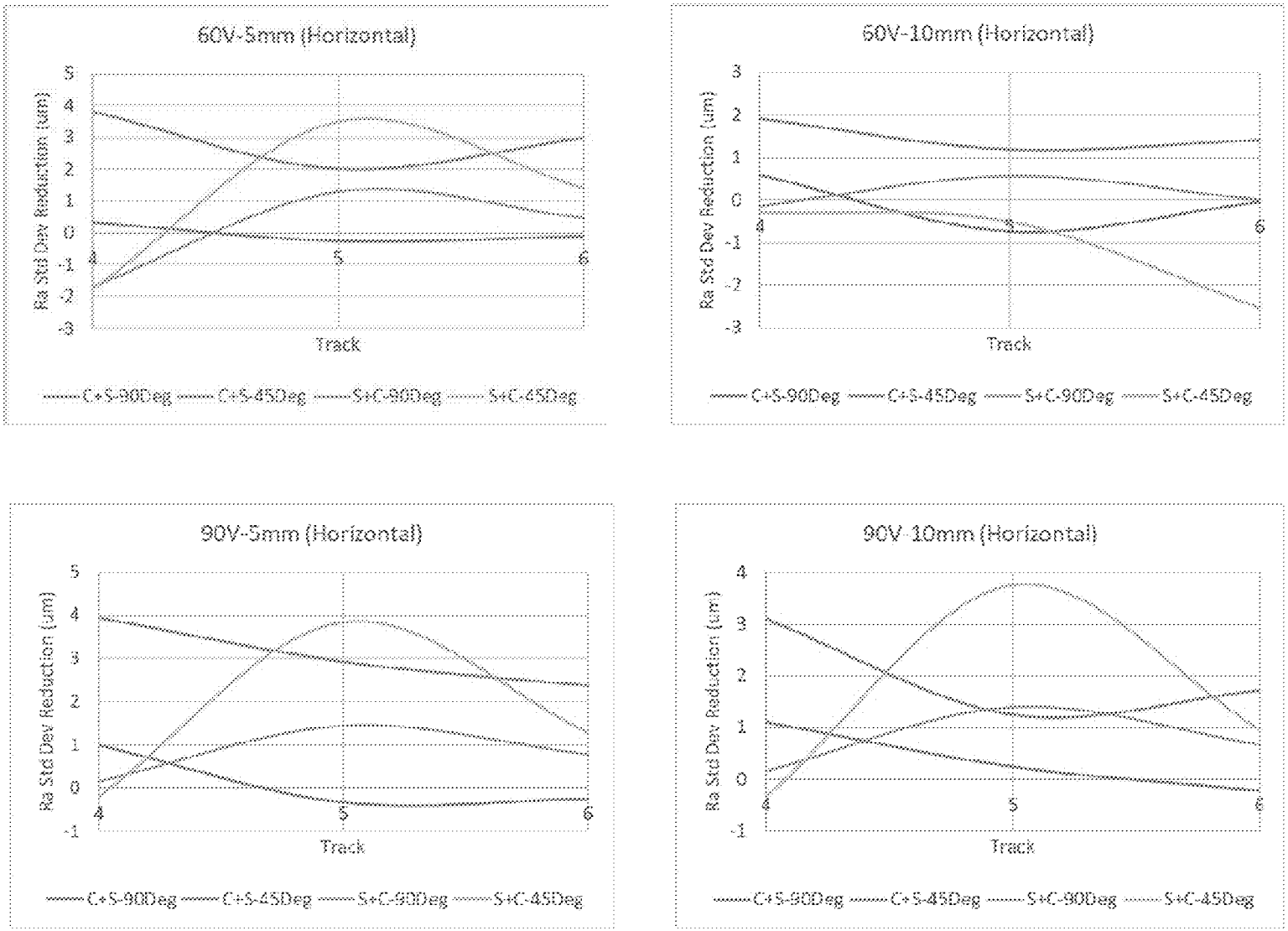
Figure 12A:
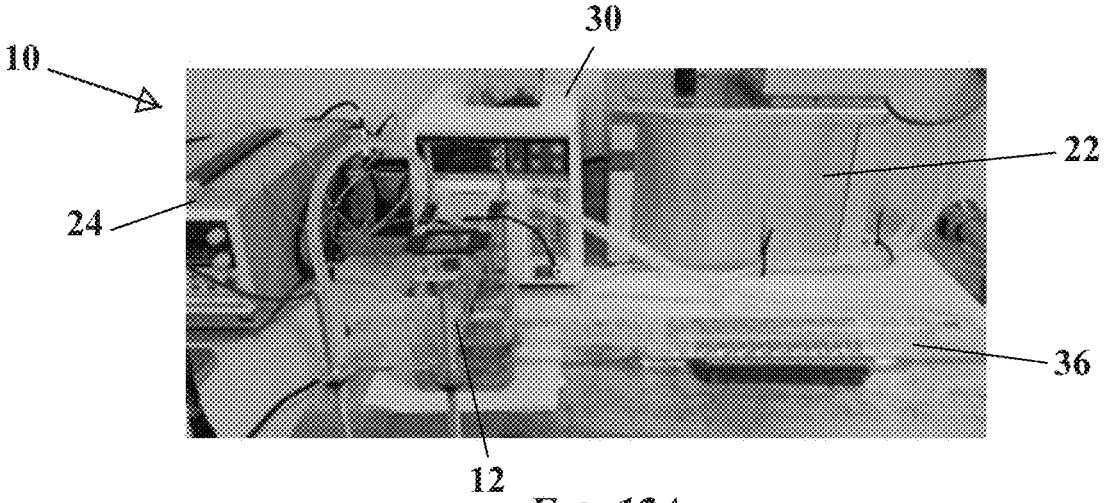
FIGS. 12A and 12B are photographs of an electropolishing system.

In a further Example, a process in accordance with the presently disclosed subject matter is illustrated in FIGS. 7-10. By way of example, FIG. 7 illustrates a flow simulation of an electrolyte reaction container 12 having a cubic shape; FIG. 8 illustrates a flow simulation of an electrolyte reaction container 12 having an elongate flow pathway; FIG. 9 illustrates a flow simulation of an electrolyte reaction container 12 having a design with a curved side wall design on the front side of the workpiece 14 (the polishing side); and FIG. 10 illustrates a flow simulation of an electrolyte reaction container 12 having a curved side wall and a curved bottom wall. The flow path FL of the electrolyte (inflow I to outflow O) is shown by the direction of the arrows in the upper panel of each of FIGS. 7 to 10. The lower panel of each of FIGS. 7 to 10 shows flow stream lines. The four different container designs have different electropolishing effectiveness for a workpiece, such as a workpiece having a thin flat shape. The laminated flow results in high controllability of flow rate as well as flow rate uniformity, which is desirable for the objective of polishing rate control. On the other hand, turbulent flow results in more non-selective polishing across the specimen surface, which might be desirable for work pieces with particular geometries.

FIG. 7 shows the significant variation of electrolyte flow rate that can be provided across the sample surface, with flow less laminated on front side of workpiece 14 (polishing side) and turbulent flow on back side of workpiece 14. FIG. 8 shows that less variation of electrolyte flow rate can be provided across the workpiece front side (polishing side) with turbulent flow on back side of workpiece 14. FIG. 9 shows a highly regulated electrolyte flow across workpiece front side (polishing side), with turbulent flow on the back side of workpiece 14. FIG. 10 shows significant turbulent flow across the entire sample. Thus, FIGS. 7-10 show the range of approaches afforded by the processes and systems of the presently disclosed subject matter.

Referring to FIGS. 11A-11D, an example of a process for electropolishing according to the presently disclosed subject matter is illustrated. Particularly, the effect of electropolishing voltage and electrode spacing on the surface roughness characteristics of metal additive manufacturing samples ($Ti_6Al_4V$) fabricated under different process conditions (thus exhibit different surface characteristics) are shown. Electropolishing voltages ranged from 60V to 90V. Electrode spacing ranged from 5 mm to 10 mm. The S+C and C+S in the graphics represent two process settings of the laser powder bed fusion additive manufacturing system used to generate the workpiece to be treated, "Hatch scan+contour scan" and "Contour scan+hatch scan", respectively. During the processing of each layer, the system controls the laser to fill the interior of the processed slice cross section first, then scan the contour of it ("Hatch scan+contour scan"), or the opposite sequence. Depending on the sequence of the laser scanning, there are actually some differences of surface characteristics of the parts, such as texture, roughness, etc. There are also potentially some sub-surface characteristic differences, such as porosity. So, the two process conditions represent different workpiece fabrication conditions, which further conveys that the electropolishing process in accordance with the presently disclosed subject matter can be tailored for different part condition (in this case, generated by different process setting). In addition, the workpiece placement orientation of 45° and 90° in relation to the horizontal build plate are used to generate different surface staircase effect, as in typical AM process the parts are fabricated layer by layer.

Continuing with reference to FIGS. 11A-11D, by applying different electropolishing process parameters with the reaction container configuration of highly regulated laminar flow of the front side of the specimen (e.g. Design 3 illustrated in FIG. 9 and configurations shown in FIGS. 48-50), the effectiveness of surface material removal and the uniformity of finished surface roughness can be controlled. Process parameters are selected based on the specific hardware configuration and specimen geometry combinations, and highly regulated surface polishing effect could therefore be achieved. FIGS. 11A-11D show surface roughness reduction standard deviation along vertical direction and surface roughness reduction standard deviation along horizontal direction This Example relates to the use of a non-aqueous alcoholic solution as disclosed herein for the electropolishing of IN718 fabricated via laser melting PBF-AM. Various process parameters including the electrode spacing, voltage, temperature and polishing time all have significant effects on the surface qualities were investigated for IN718.

The electropolishing station configuration is shown in FIG. 12. The glass electropolishing chamber 12 has an inlet I and outlet O (see FIGS. 14 and 15) on opposite sides and has a maximum volume of roughly 700 mL. The electrical voltage for polishing is controlled by the Instek PSW 160-14.4 power supply 24, the electrolyte circulation flow is driven by a Masterflex 7523-40 L/S peristaltic pump 30. A Graham condenser 36 is connected into the electrolyte flow circulation as the heat exchanger for the cooling of the electrolyte, and the cooling bath 22 is provided by a large water tank with temperature control. The cooling rate with the use of Graham condenser 36 can be limited especially when the flow rate is high. Therefore, in the current study over-compensated control scenario was used, which involved the use of ice water for more rapid cooling once the electropolishing reaction initiated.

Figure 13:
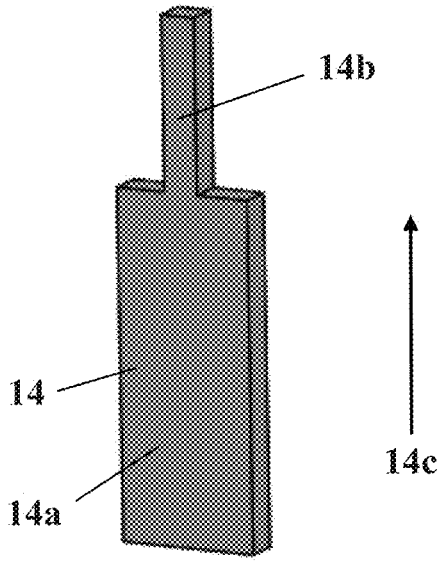
FIG. 13 is a schematic perspective view of a workpiece to be treated.
Figure 12B:
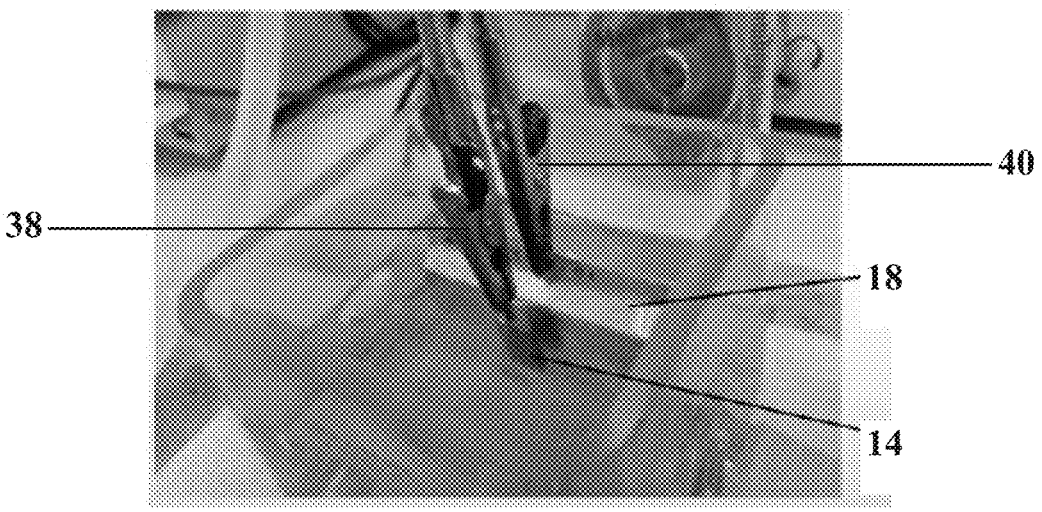
Figure 14:
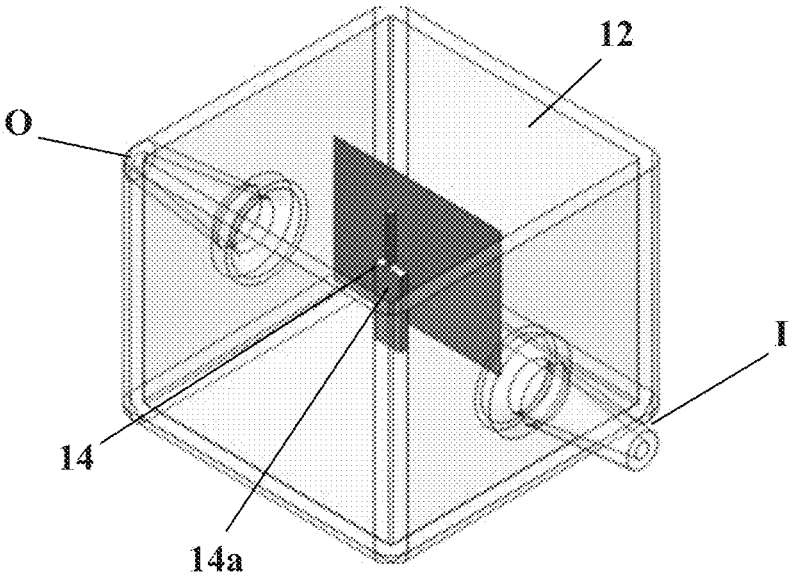
FIGS. 14 and 15 are schematic perspective views of a container as used in FIGS. 12A and 12B.
Figure 15:
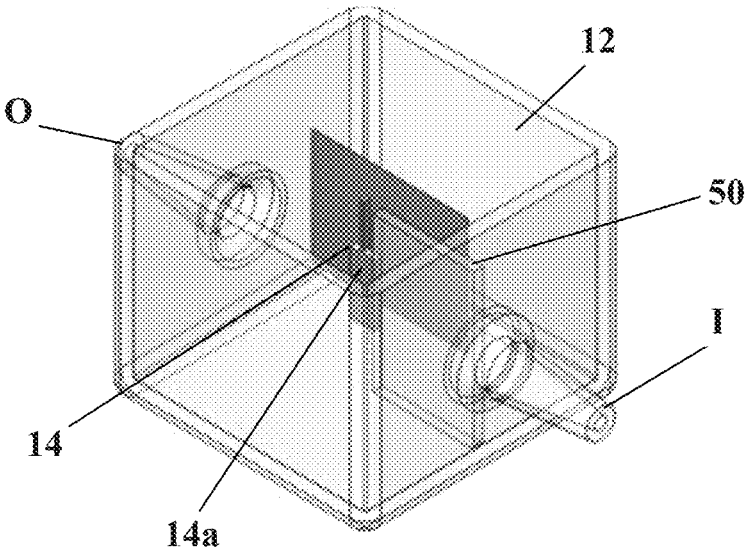

The workpiece design is shown in FIG. 13. The length of the workpiece 14 is 20 mm and the thickness of the workpiece or sample 14 is 1 mm and the length is 20 mm, although this dimension is considered less relevant to the current study. The samples were fabricated by a Concept Laser M1 system. The orientation of the sample 14 during the fabrication is also shown in FIG. 13, with surface 14*a* to be treated and grip end 14*b*. Therefore, the surfaces used for experimentation are vertical surfaces 14*a*. From the preliminary fluid flow simulation it was shown that the inlet and outlet configuration of the polishing chamber does not introduce well-regulated fluid flow. In order to evaluate the effect of fluid flow, a more regulated laminar flow is introduced. Therefore, a flow-splitter 50 was introduced in the experimental setup. As shown in FIGS. 14 and 14, the splitter 50 was placed in the polishing chamber 12 near the flow inlet I, and the surface of the splitter 50 is aligned with the sample surfaces 14*a*. In order to verify the effectiveness of the split configuration, additional fluid flow simulations were carried out.

To investigate the effect of each parameter on the surface quality of the IN718 parts, a $5^2$ full factorial experimental design was developed. As shown in Table 1, five input variables, including temperature, electrode spacing, voltage, flow rate and split configuration were investigated, with each variables having 2 levels. For the electrolyte, the following recipe was used: 1 L of electrolyte comprises: 700 mL of ethyl alcohol, 300 mL of isopropyl alcohol, 60 g $AlCl_3$ and 250 g $ZnCl_2$. 1 sample was polished for each parameter combinations. After polishing, the surface roughness of the samples were measured with a Dektak 8 profilometer along the longest direction (i.e. build direction 14*c* as shown in FIG. 13). Three measurements were made for each sample with spacing across the width of the sample approximated by the eyeballing of the operator. In addition, the surface roughness of the as-received samples was also characterized. In order to verify the even effectiveness of the split configuration, additional fluid flow simulations were carried out using SolidWorks Flow Simulation with the flow rate setup shown in Table 1.

TABLE 1

Experimental Design Table

| Variables | Levels |
|---|---|
| Temperature (° C./° F.) | 26.7/80, 37.8/100 |
| Electrode spacing (mm) | 7.5, 15 |
| Flow rate (mL/min) | 800, 1200 |
| Voltage (V) | 60, 80 |
| Split configuration | Yes, No |

In the fluid flow simulations, the viscosity value of the electrolyte was taken as 9.58 cP, which was obtained via the measurement with the fresh electrolyte solution using viscometer. The effect of temperature on viscosity was ignored during the simulation. The measured surface roughness of the as-received sample was used to set up surface roughness in the simulations. The electrode spacing was set to be 7 mm for all the simulations.

TABLE 2

Surface Roughness Measurement Results

| # | Vol (V) | Temp (° F.) | S (mm) | FR (mL/m) | Split | $R_a$ (μm) |
|---|---|---|---|---|---|---|
| 1 | 60 | 80 | 7 | 800 | N | 2.678 |
| 2 | 60 | 80 | 7 | 800 | Y | 2.728 |
| 3 | 60 | 80 | 7 | 1200 | N | 4.160 |
| 4 | 60 | 80 | 7 | 1200 | Y | 3.123 |
| 5 | 60 | 80 | 15 | 800 | N | 3.015 |
| 6 | 60 | 80 | 15 | 800 | Y | 2.970 |
| 7 | 60 | 80 | 15 | 1200 | N | 2.863 |
| 8 | 60 | 80 | 15 | 1200 | Y | 3.578 |
| 9 | 60 | 100 | 7 | 800 | N | 1.904 |
| 10 | 60 | 100 | 7 | 800 | Y | 2.070 |
| 11 | 60 | 100 | 7 | 1200 | N | 3.003 |
| 12 | 60 | 100 | 7 | 1200 | Y | 2.810 |
| 13 | 60 | 100 | 15 | 800 | N | 3.297 |
| 14 | 60 | 100 | 15 | 800 | Y | 1.808 |
| 15 | 60 | 100 | 15 | 1200 | N | 3.620 |
| 16 | 60 | 100 | 15 | 1200 | Y | 3.112 |
| 17 | 80 | 80 | 7 | 800 | N | 2.716 |
| 18 | 80 | 80 | 7 | 800 | Y | 4.249 |
| 19 | 80 | 80 | 7 | 1200 | N | 2.682 |
| 20 | 80 | 80 | 7 | 1200 | Y | 2.991 |
| 21 | 80 | 80 | 15 | 800 | N | 3.079 |
| 22 | 80 | 80 | 15 | 800 | Y | 3.762 |
| 23 | 80 | 80 | 15 | 1200 | N | 3.050 |
| 24 | 80 | 80 | 15 | 1200 | Y | 3.140 |
| 25 | 80 | 100 | 7 | 800 | N | 2.080 |

TABLE 2-continued

| Surface Roughness Measurement Results | | | | | | |
|---|---|---|---|---|---|---|
| # | Vol (V) | Temp (° F.) | S (mm) | FR (mL/m) | Split | $R_a$ (μm) |
| 26 | 80 | 100 | 7 | 800 | Y | 4.673 |
| 27 | 80 | 100 | 7 | 1200 | N | 4.272 |
| 28 | 80 | 100 | 7 | 1200 | Y | 2.808 |
| 29 | 80 | 100 | 15 | 800 | N | 3.812 |
| 30 | 80 | 100 | 15 | 800 | Y | 2.064 |
| 31 | 80 | 100 | 15 | 1200 | N | 2.512 |
| 32 | 80 | 100 | 15 | 1200 | Y | 1.791 |

Figure 16:
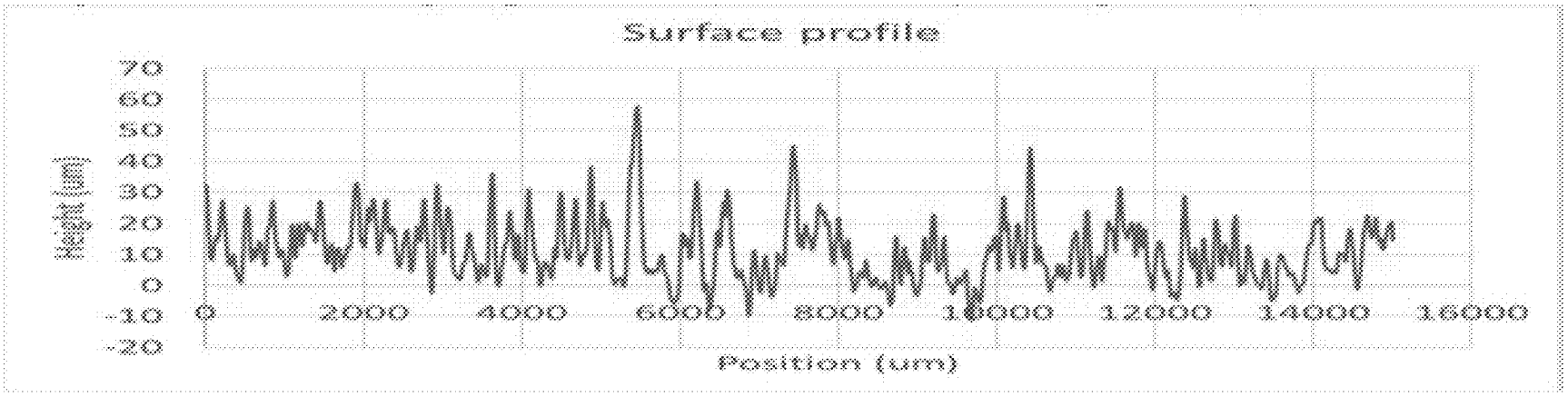
FIGS. 16-18 are plots showing typical surface profile of the as-received IN718 samples (FIG. 16), while the typical surface profiles of the polished samples are shown in FIGS. 17-18.
Figure 17:
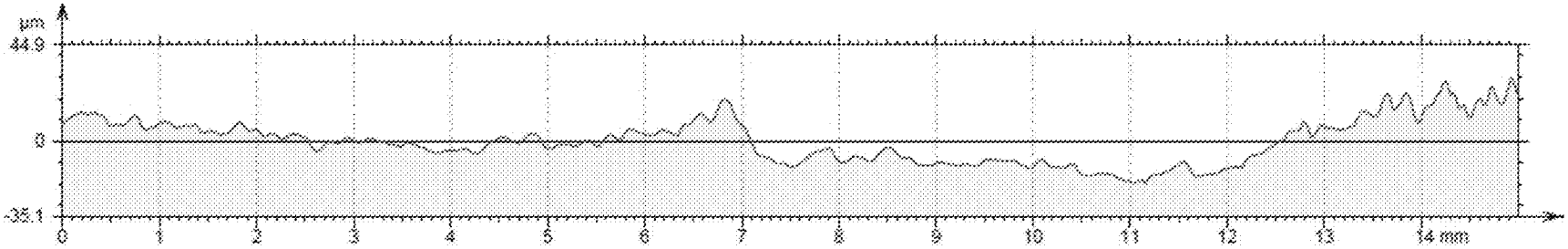
Figure 18:
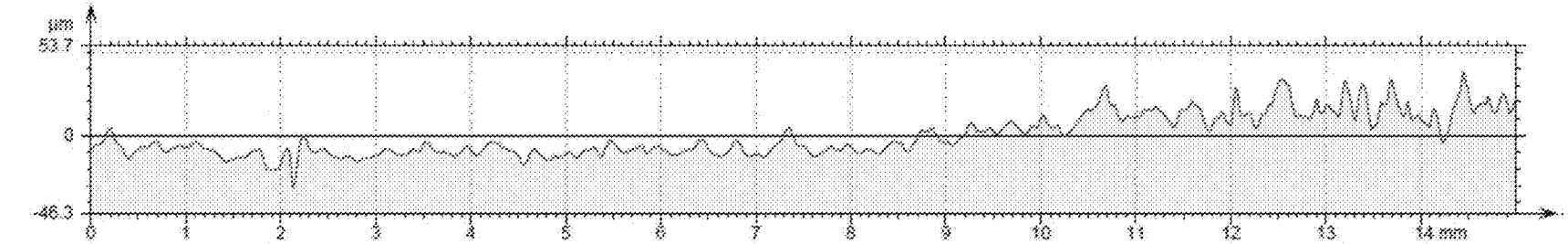

The typical surface profile of the as-received IN718 samples is shown in FIG. 16, while the typical surface profiles of the polished samples are shown in FIGS. 17-18. The surface roughness of the as-received samples is Ra 7.90±0.326 μm. It can be observed visually that the surface polish had significant effects, as there exist significantly fewer peaks and valleys on the profiles. The surface roughness Ra of each type of sample are listed in Table 2. The differences between the non-split configuration and split configuration does not appear to be significant, as the average surface roughness of the two groups are 3.05 μm and 2.98 μm, respectively.

Figure 19:
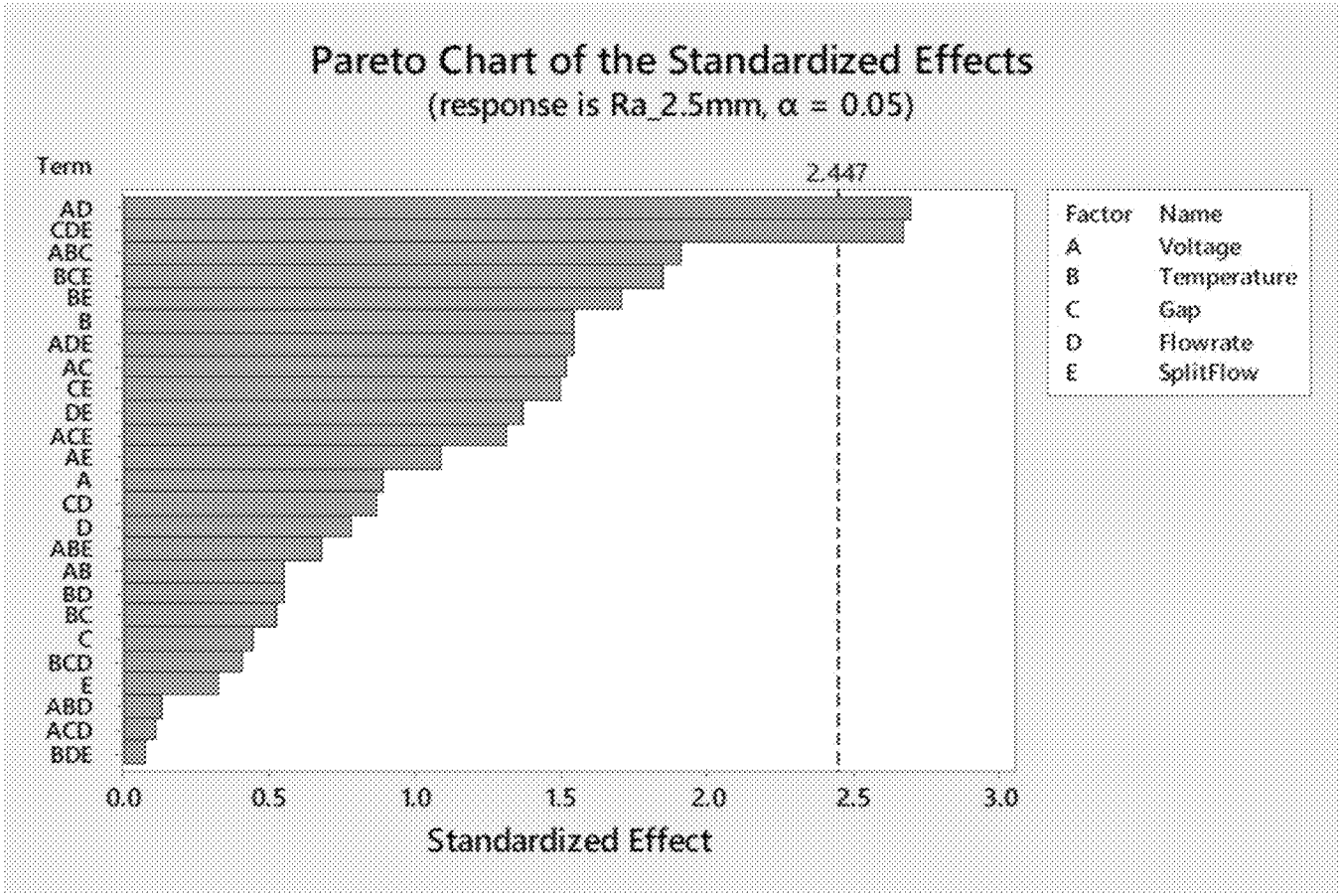
FIG. 19 is a Pareto Chart of standardized effects.
Figure 20:
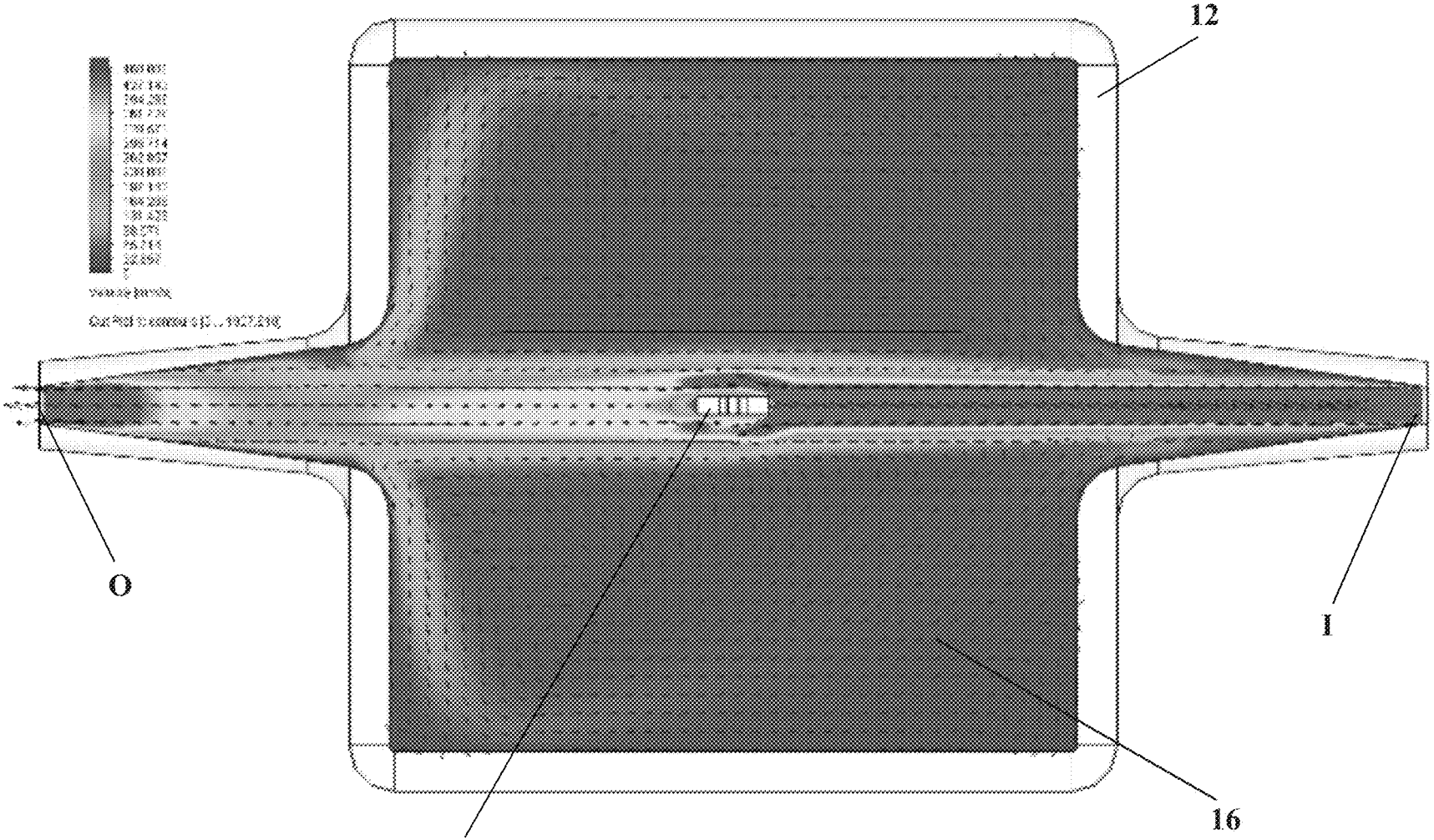
FIGS. 20-23 are schematic drawings illustrating electrolyte flow in various container configurations with (FIG. 20, 800 mL/m flow rate—no split.
Figure 21:
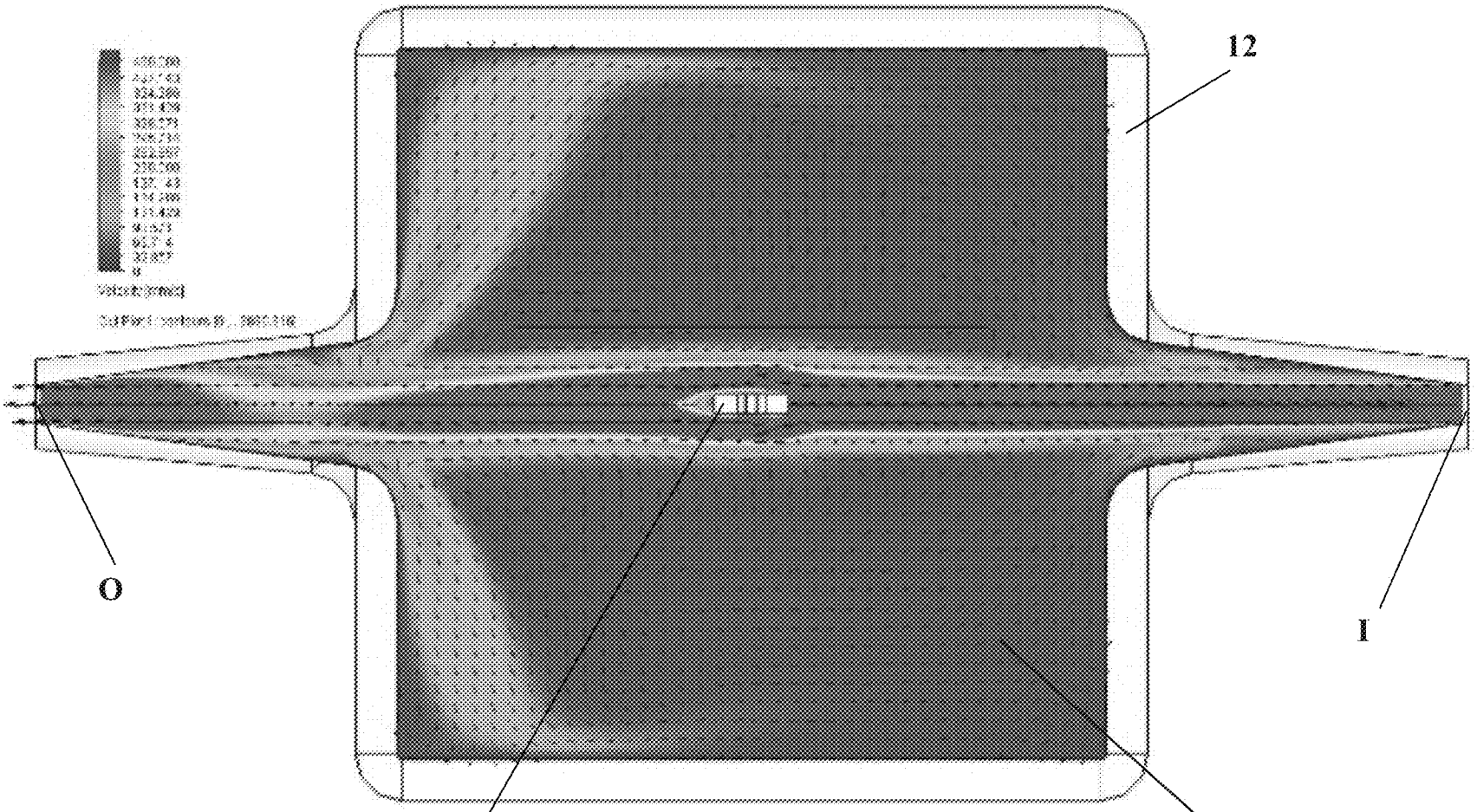
Figure 22:
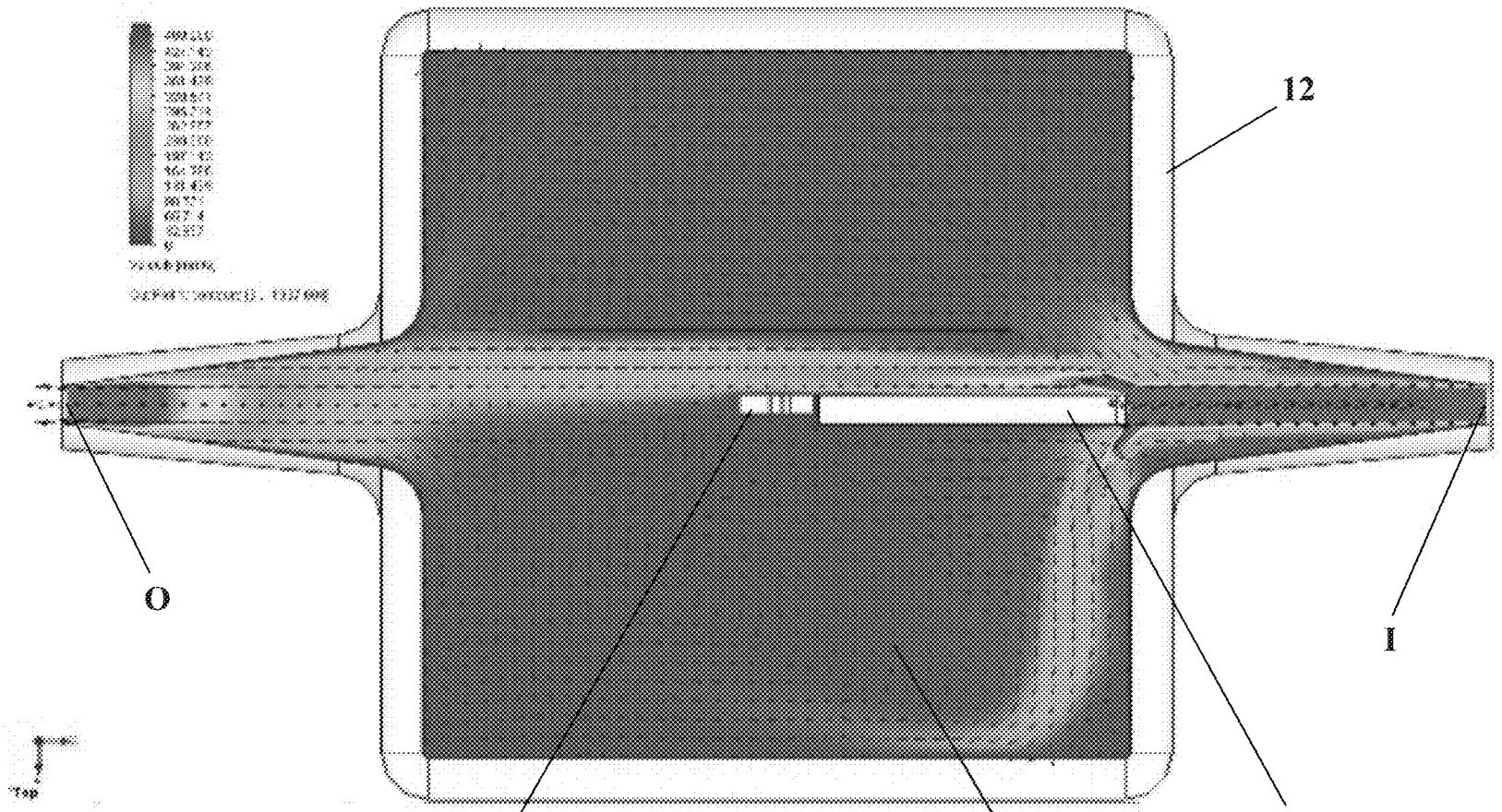
Figure 23:
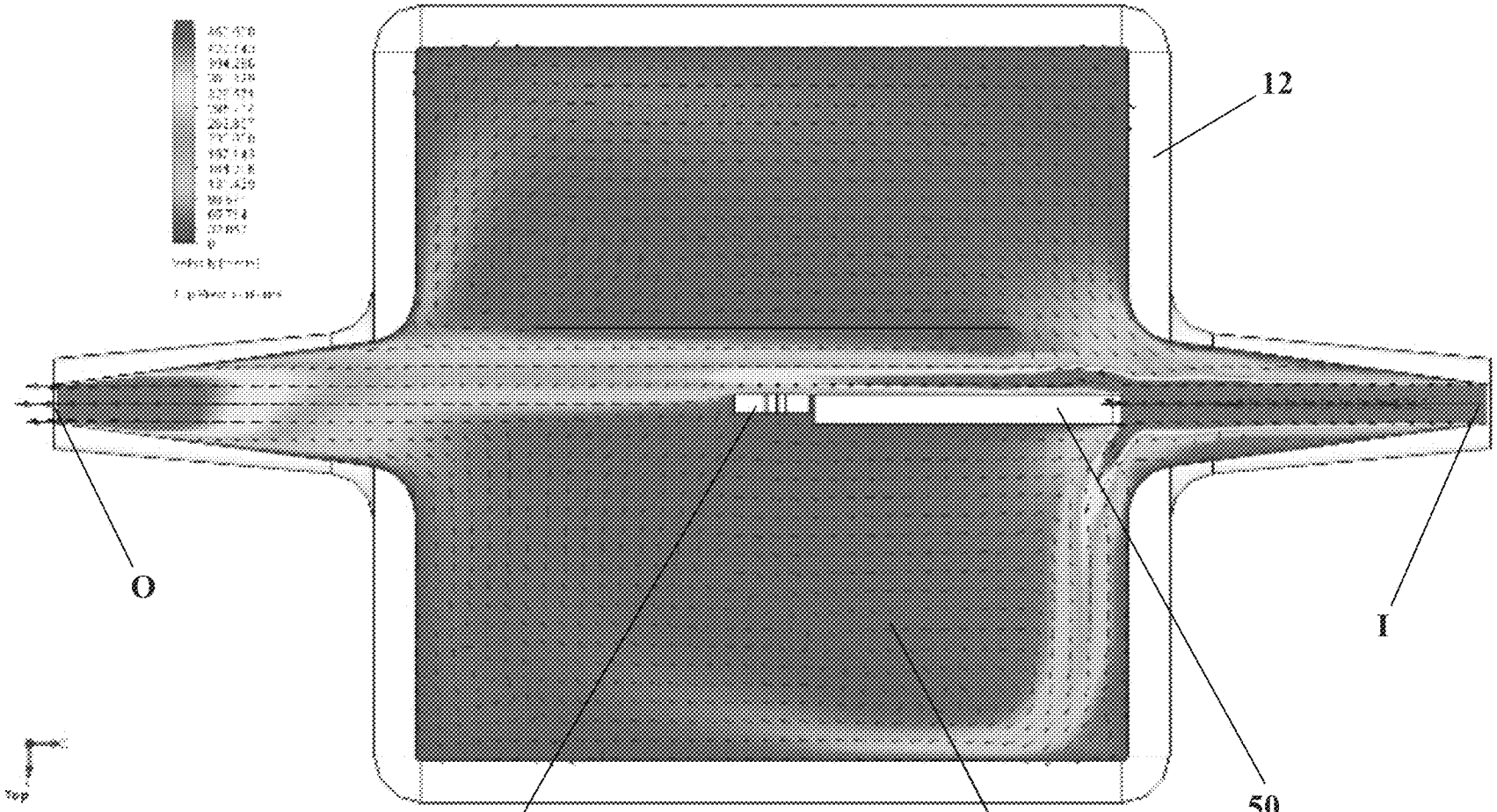
Figure 24:
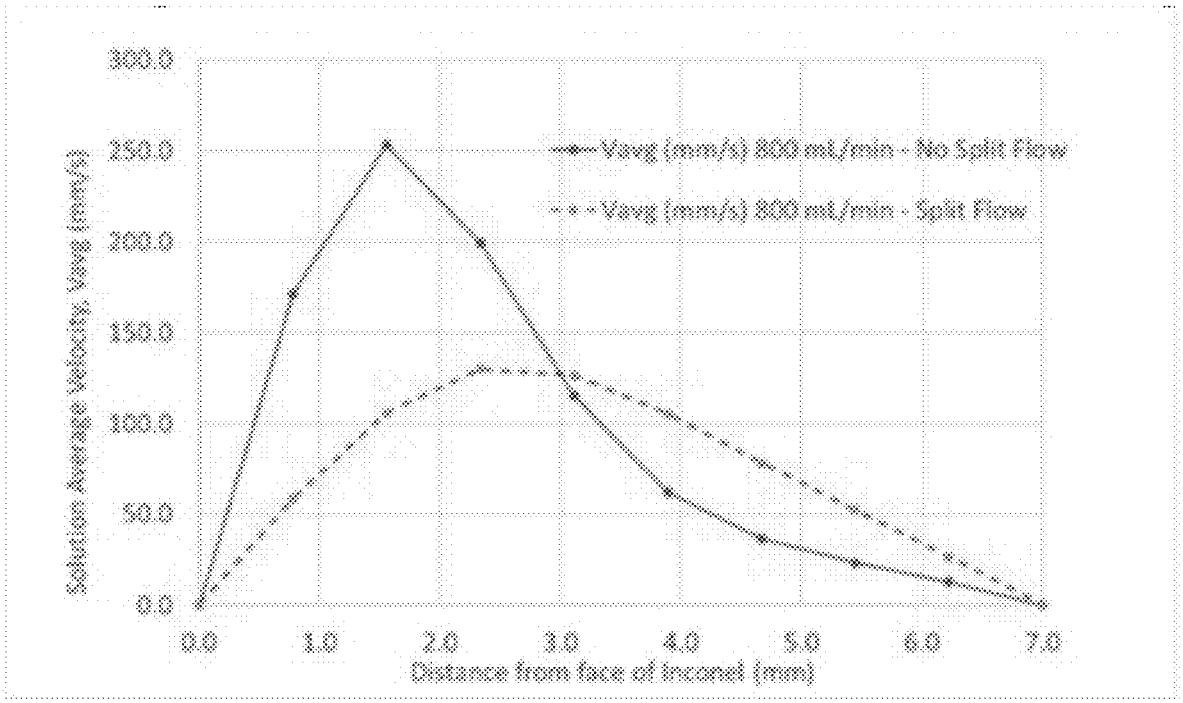
FIGS. 24-27 are plots of flow velocity along the planes at varying distances from the sample surfaces Flow velocity along the planes at varying distances from the sample surfaces (FIGS. 24 and 25, 800 mL/m flow rate.
Figure 25:
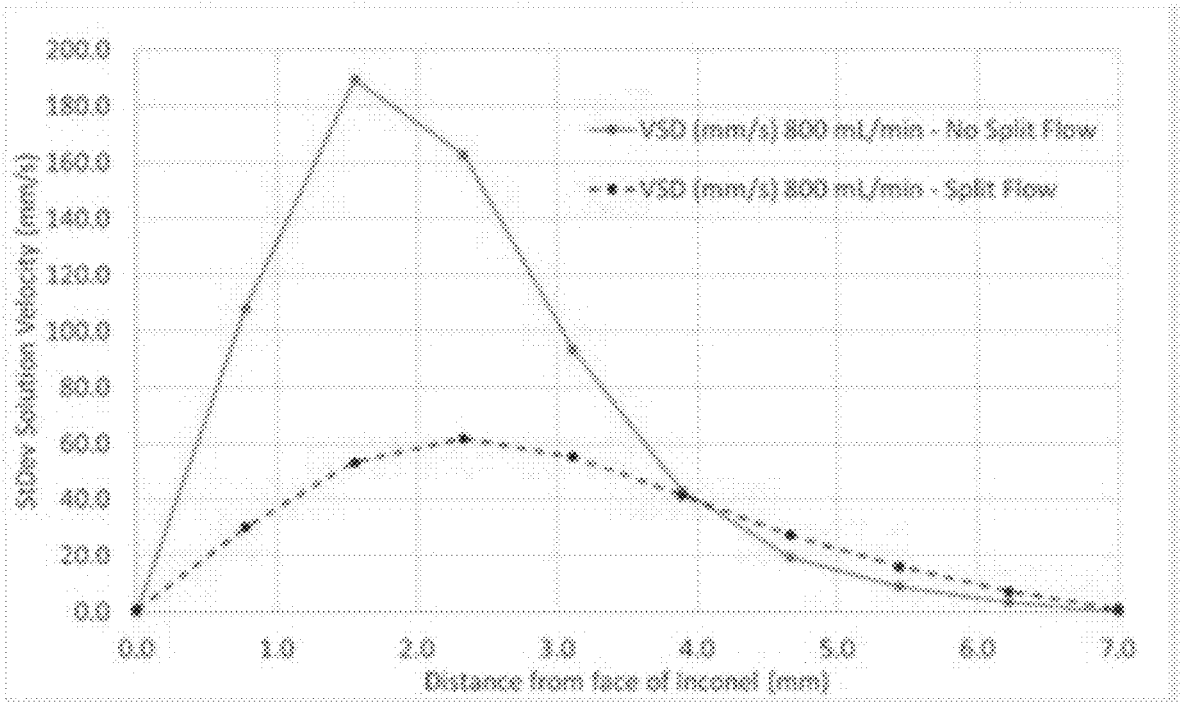
Figure 26:
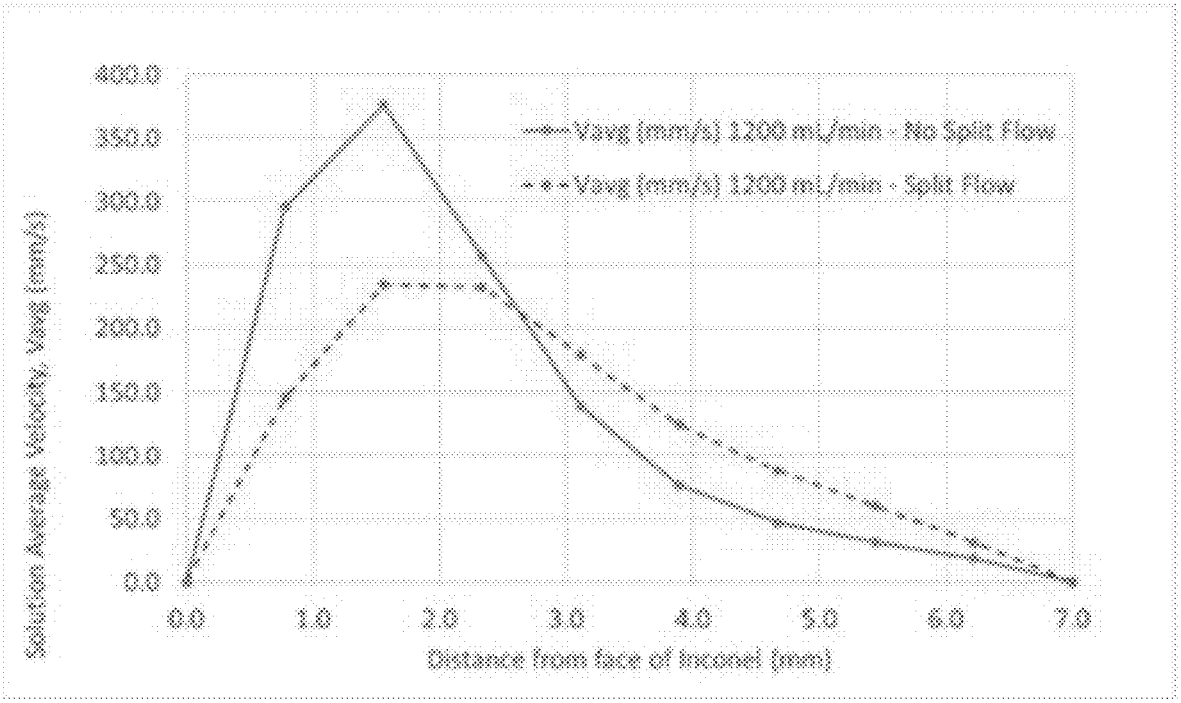
Figure 27:
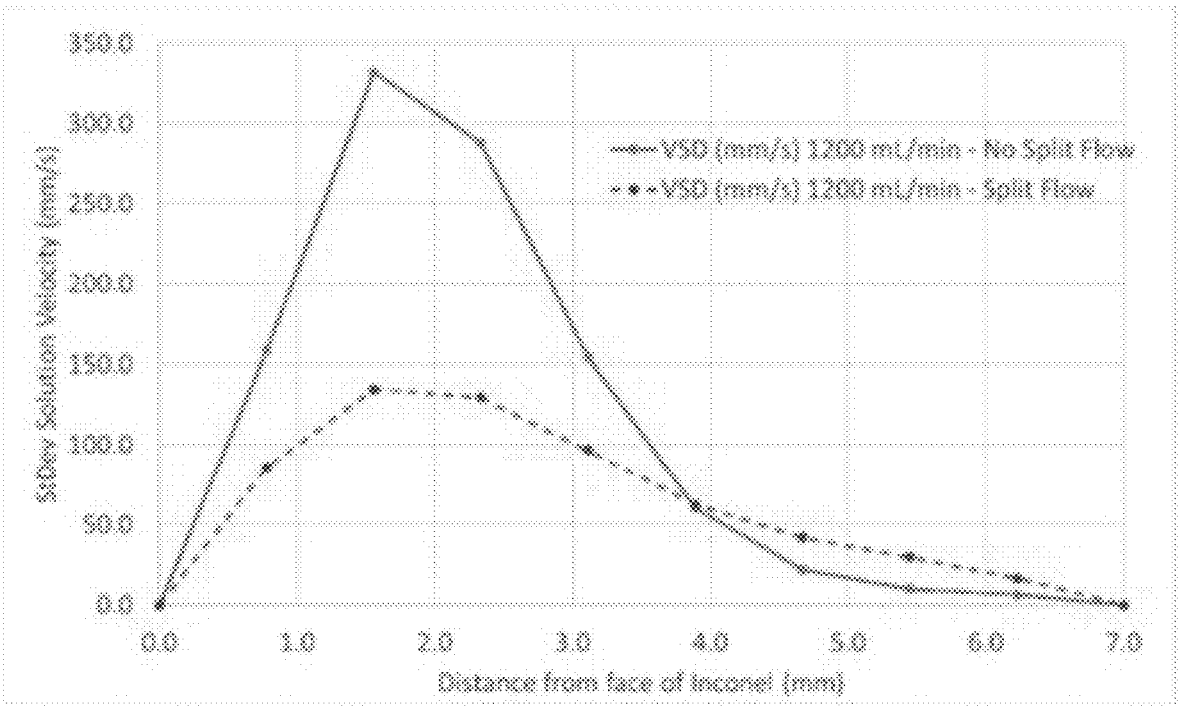

Further analysis with the results using ANOVA provided additional insights into the significance of each design factors and their interactions. FIG. 19 shows the standardized effects of design factors on the average surface roughness value of each types of sample. From FIG. 19 the 2-way interaction of voltage and flow rate (AD) and the 3-way interaction of electrode spacing (gap), flow rate and split configuration (CDE) both have significant effect on the average surface roughness. From the principles of electropolishing the significance of the 3-way interaction (CDE) is readily justified. During the electropolishing processes the $Ni^{2+}$ ions are released from the samples under the driving energy of the electrical fields, and consequently transported away from the surface via electrolyte circulation. Therefore, the fluid flow characteristics of the electrolyte could significantly influence the mass transportation of the $Ni^{2+}$ ions and consequently the polishing efficiency. This is further elaborated by the results from the fluid flow simulation studies.

As shown in FIGS. 20-23, for the no-splitter configurations (FIGS. 20-21), the fluid flows of the electrolyte exhibit experience significant disruptions at the sample front caused by the sample leading edges, and such effect is more pronounced as the flow rate increases. The fluctuation of the fluid flow rates across the samples are further elucidated in FIGS. 24-27, which shows the average fluid flow velocities and their variabilities on the planes parallel to the sample surfaces at varying distances. Without the use of the split configuration, the highest average flow rates of the electrolyte occur at about 1.5 mm from the sample surfaces, although the standard deviations also peak at that distance, indicating highly non-uniform electrolyte flow rate. With the split configuration, the maximum average flow rates occur at slightly higher planes (~2 mm) from the sample surfaces. Also, the variabilities of the average flow rate at difference distances from the sample surfaces as well as the flow rate on each investigated planes are significantly smaller compared to the no-split configurations.

Figure 28:
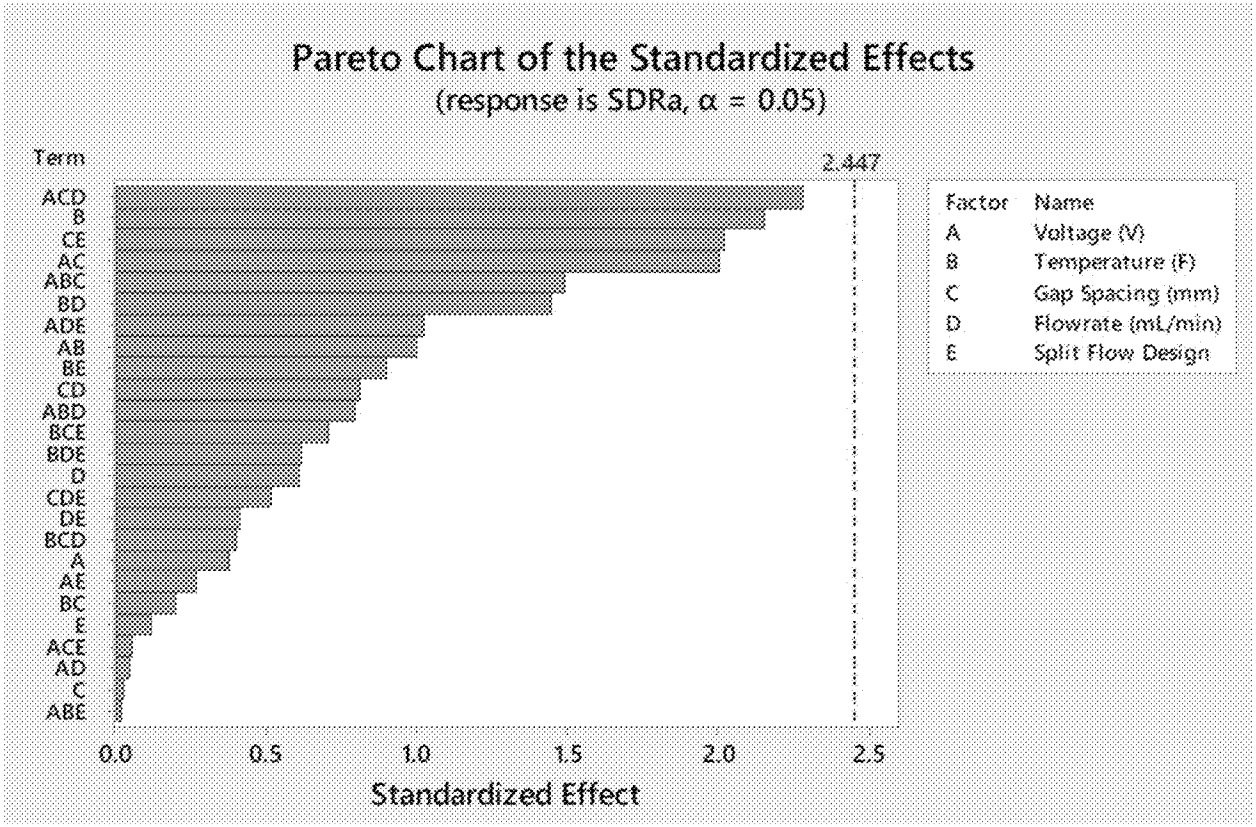
FIG. 28 is a Pareto Chart of standardized effects.

The better-regulated electrolyte flow control with the split configuration also appears to have some effects on the uniformity of the surface roughness, although the effect is not as significant. FIG. 28 shows the standardized effect of design factors on the standard deviation of the surface roughness values. The 3-way interaction of voltage, spacing and flow rate, the temperature, the 2-way interactions of spacing and split configuration as well as voltage and spacing appear to be the most significant factors, although none achieved a significance level that corresponds to a $p<0.05$ of confidence level.

The significance of the interaction between the voltage and the factors for flow control (flow rate, split configuration) might be a result of the change of significance of the ion mass transportation through the electrolyte due to the reaction rate change. With higher electropolishing voltage the ion release rate from the sample might be enhanced, which would facilitate the mass transportation limiting electropolishing mechanism that is highly influenced by the electrolyte flow. On the other hand, the relatively low significance levels for various factors might be a result of the fact that relatively low electropolishing rates were observed in the experiments, which might correspond to a more "passive" electropolishing process that is dominated by macromachining. This electropolishing mechanism tends to be less sensitive to the electrolyte flow and would reduce large features more effectively while lacks the efficiency to reduce micro-protrusions on the part surfaces. In addition, the lack of accurate control of temperature (i.e. via the use of ice water that establishes an open-loop control) might also have contributed to the low significance of temperature factor.

In this study, an experimental design was employed to evaluate the significance of various process variables (voltage, temperature, electrode spacing, electrolyte flow rate and flow rate uniformity) on the surface quality of the IN718 parts fabricated via laser melting PBF-AM process. Overall, the use of electropolishing was able to achieve average surface roughness of Ra~3 μm that is a significant improvement compared to the original surfaces.

The voltage used for the experiment might not have achieved a significant level to introduce mass transportation limiting polishing mechanism.

Figure 29:
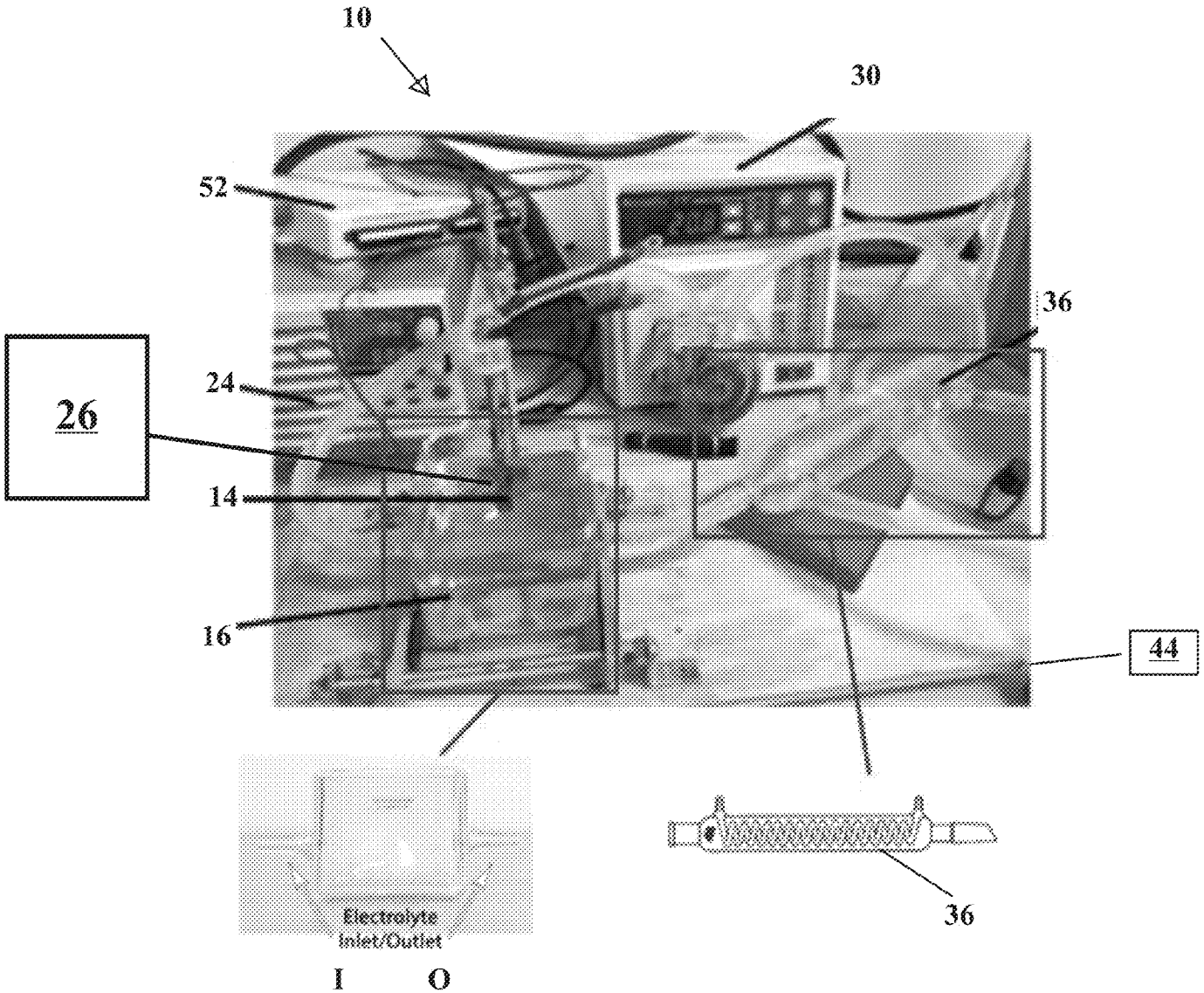
FIG. 29 is a photograph of a representative electropolishing system.
Figure 30:
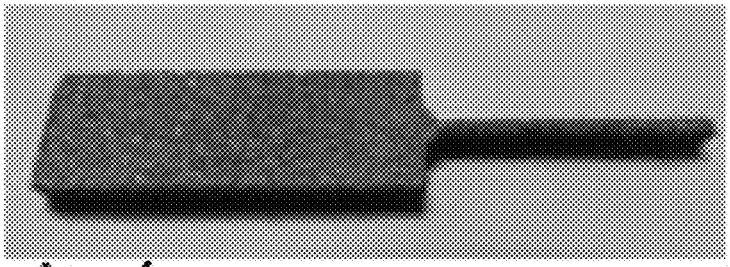
FIG. 30 is a photograph of a workpiece to be electropolished.
Figure 31:
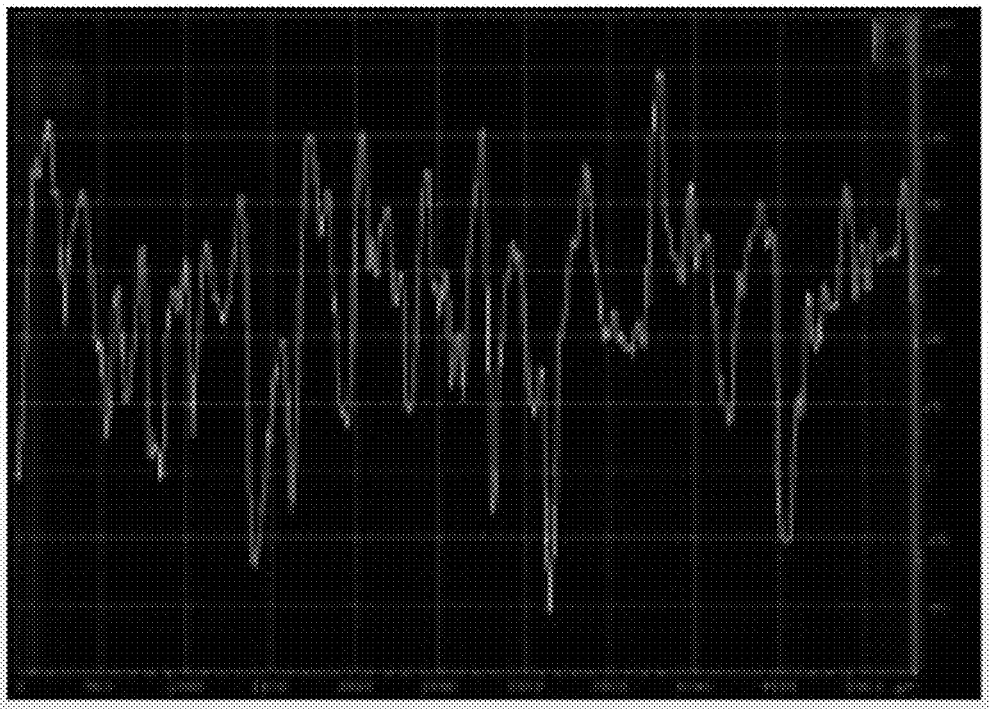
FIG. 31 is a profilometer readout of the as-received sample surface (Ra 30-40 μm) of the workpiece in FIG. 30.

This Example relates to the corrosion-resistant electrolyte circulation system 10 shown in FIG. 29 used to treat Ti6Al4V workpieces. Custom reaction container 12 for more consistent flow control is provided. Graham condenser 36 is provided to facilitate temperature control of electrolyte solution 16. Workpiece 14 is shown in FIG. 30 and a profilometer (Zygo Corporation) readout of the as-received sample surface (Ra 30-40 μm) of workpiece 14 in FIG. 30 is shown in FIG. 31.

TABLE 3

| Experimental Design Table | |
|---|---|
| Variables | Levels |
| Temperature (° C./° F.) | 26.7/80, 37.8/100 |
| Voltage (V) | 60, 80 |
| Polishing Time (min) | 5, 10, 20 |

Figure 32:
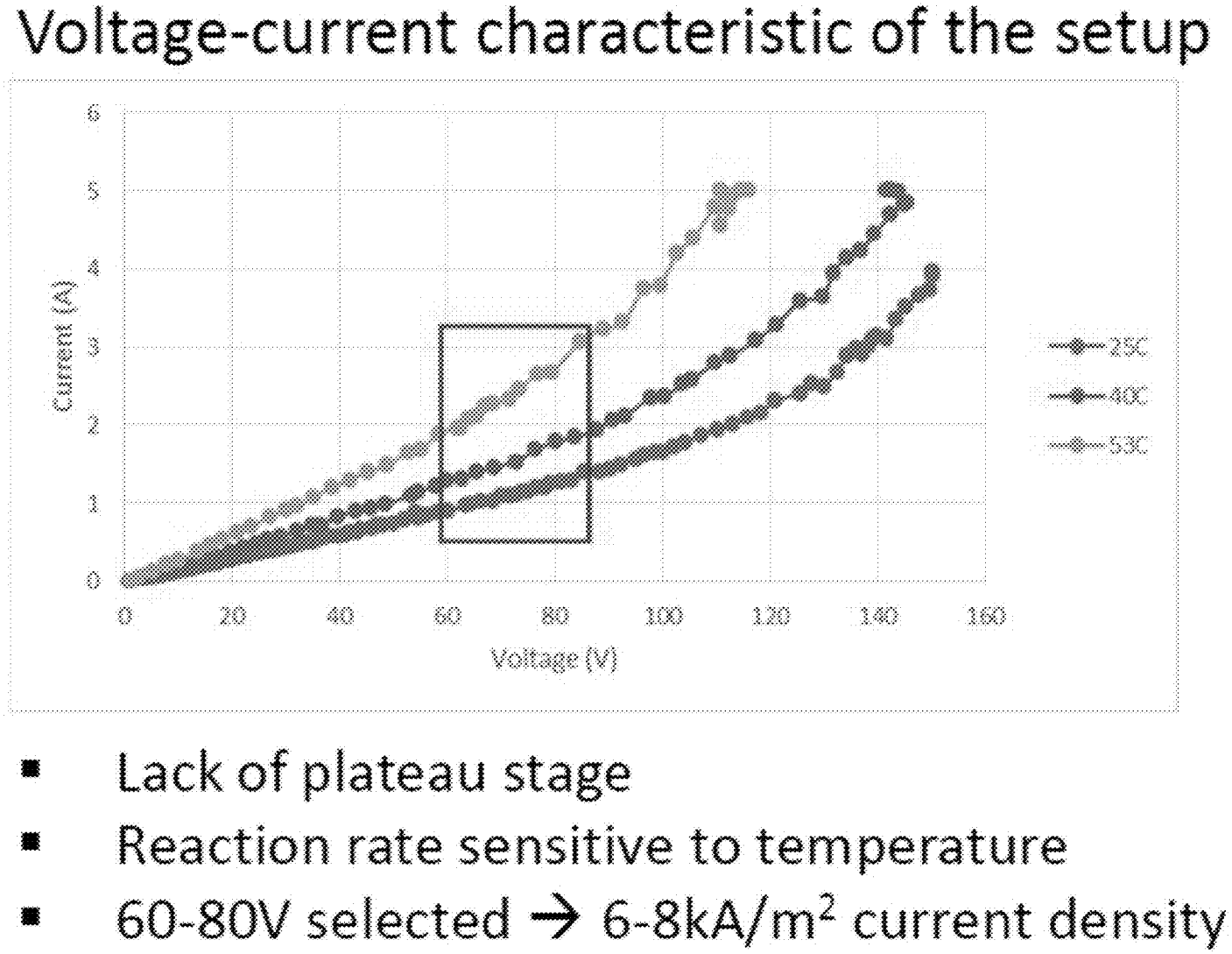
FIG. 32 is a plot showing voltage-current characteristic of the system of FIG. 29.

In this example, a lack of a plateau stage was observed, as was a reaction rate sensitive to temperature. Voltages selected were 60-80V and 6-8 $kA/m^2$ current density was provided. Treatment temperatures ranged from 38 C to 27 C. See FIGS. 32 and 33. Additional observations included significant polishing effects with longer time and higher energy levels; Non-consistent polishing causes shape accuracy loss; small-scale surface features successfully reduced; and surface finish of Ra<1 μm achieved in certain areas. Front and back sides were polished differently. See FIGS.

Figure 33:
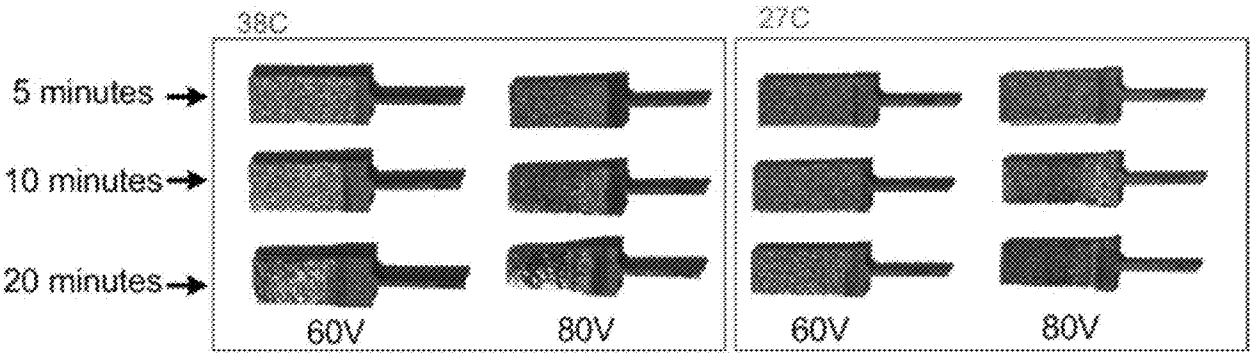
FIG. 33 is a photograph of workpieces under the indicated electropolishing conditions.
Figure 34:
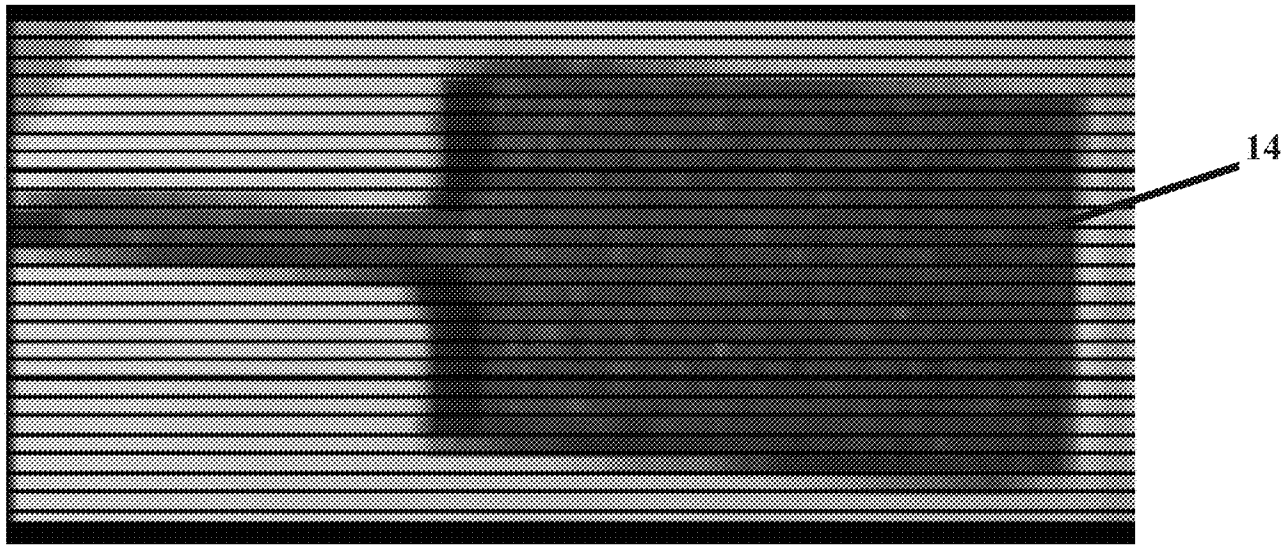
FIG. 34 is a photograph of a workpiece to be electropolished.
Figure 35:
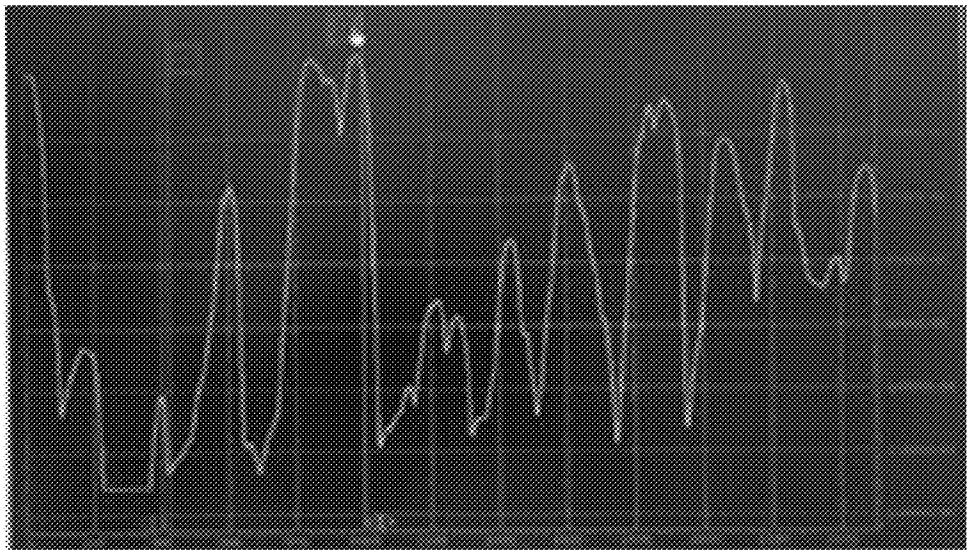
FIG. 35 is a profilometer readout of the as-received sample surface of the workpiece in FIG. 34.
Figure 36:
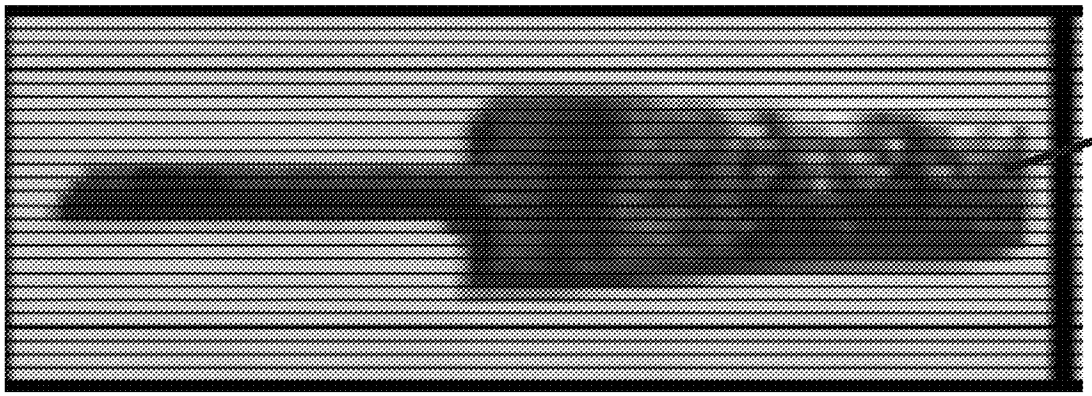
FIG. 36 is a photograph of a workpiece that has been electropolished.
Figure 37:
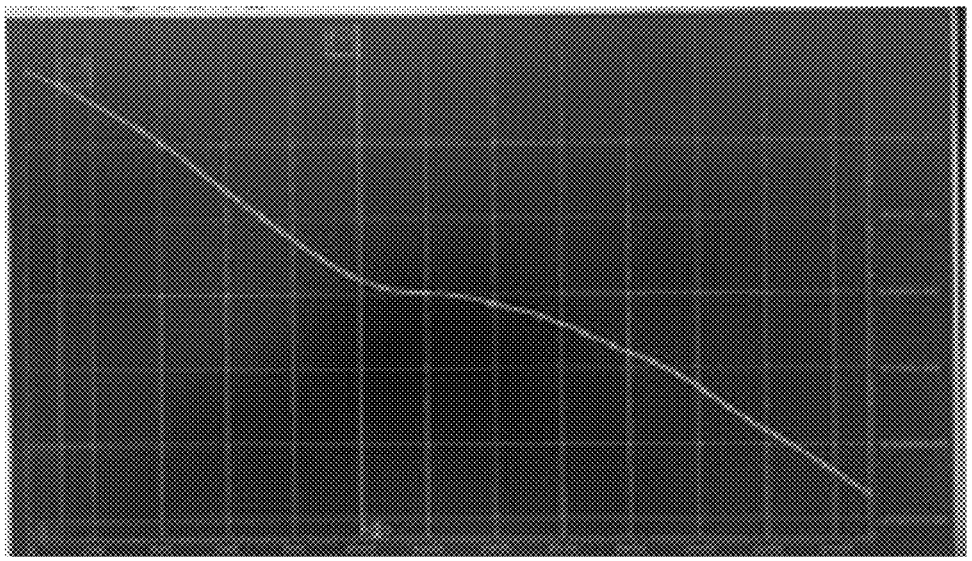
FIG. 37 is a profilometer readout of the sample surface of the workpiece in FIG. 36.
Figure 38:
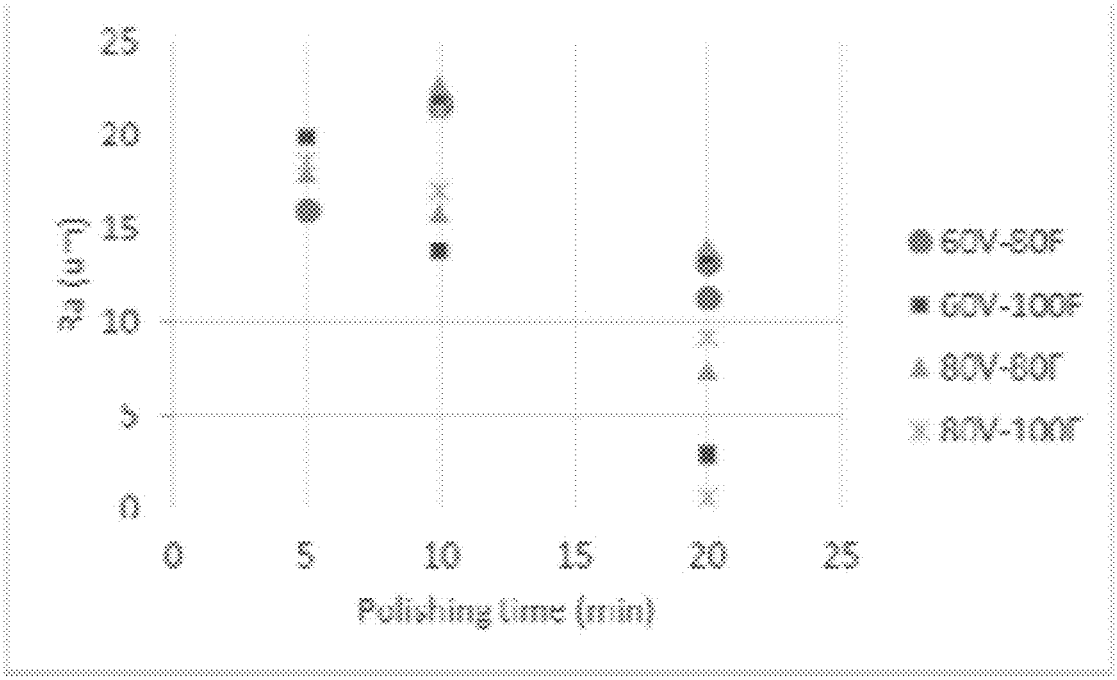
FIG. 38 is a plot of Ra versus time for front side a workpiece that has been electropolished.
Figure 39:
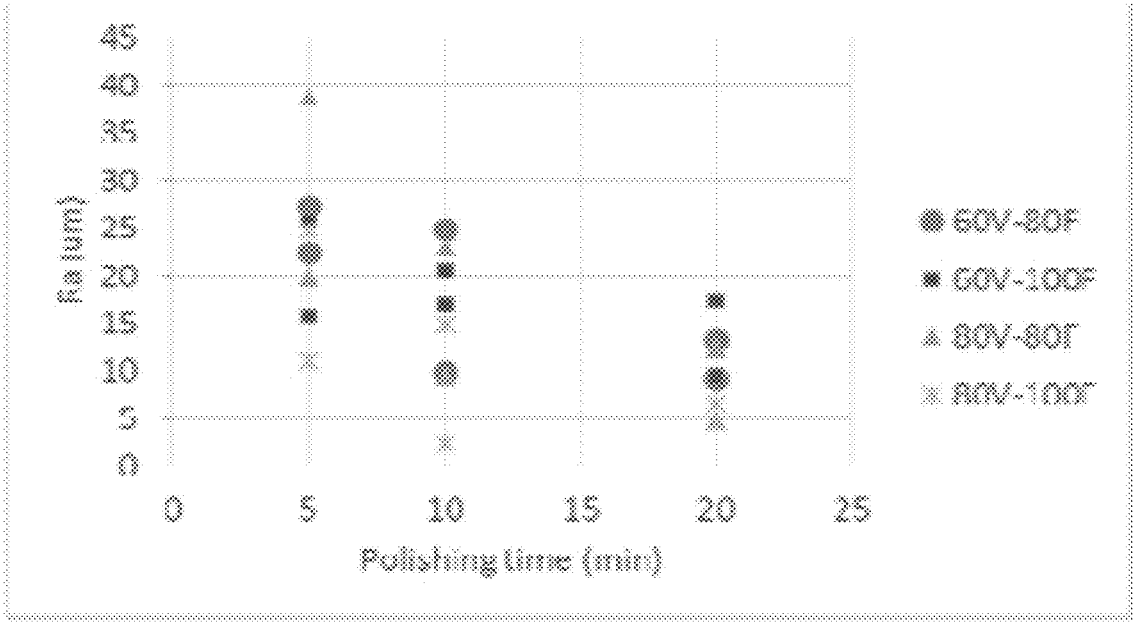
FIG. 39 is a plot of Ra versus time for back side a workpiece that has been electropolished.
Figure 40:
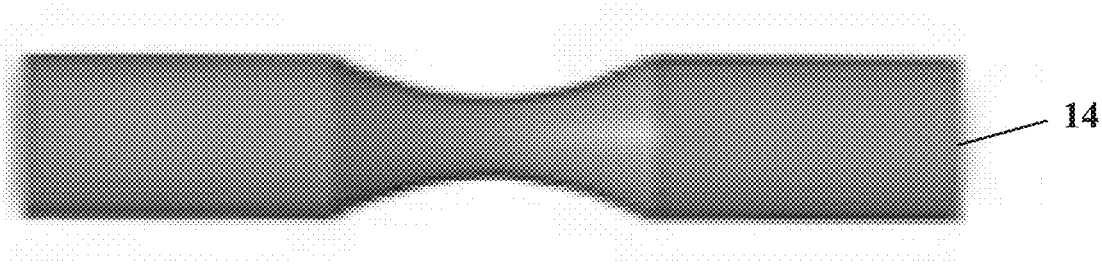
FIGS. 40 and 41 are a schematic drawing and a photograph of a workpiece to be electropolished.
Figure 41:
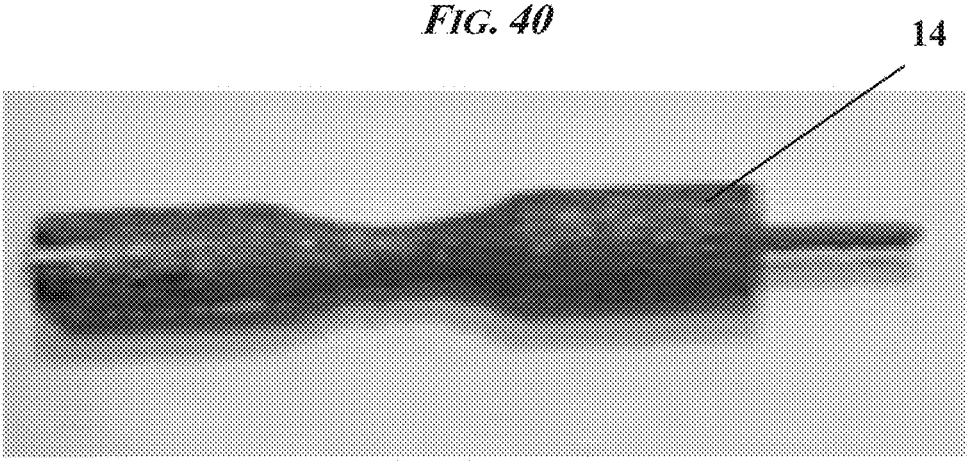
Figure 42:
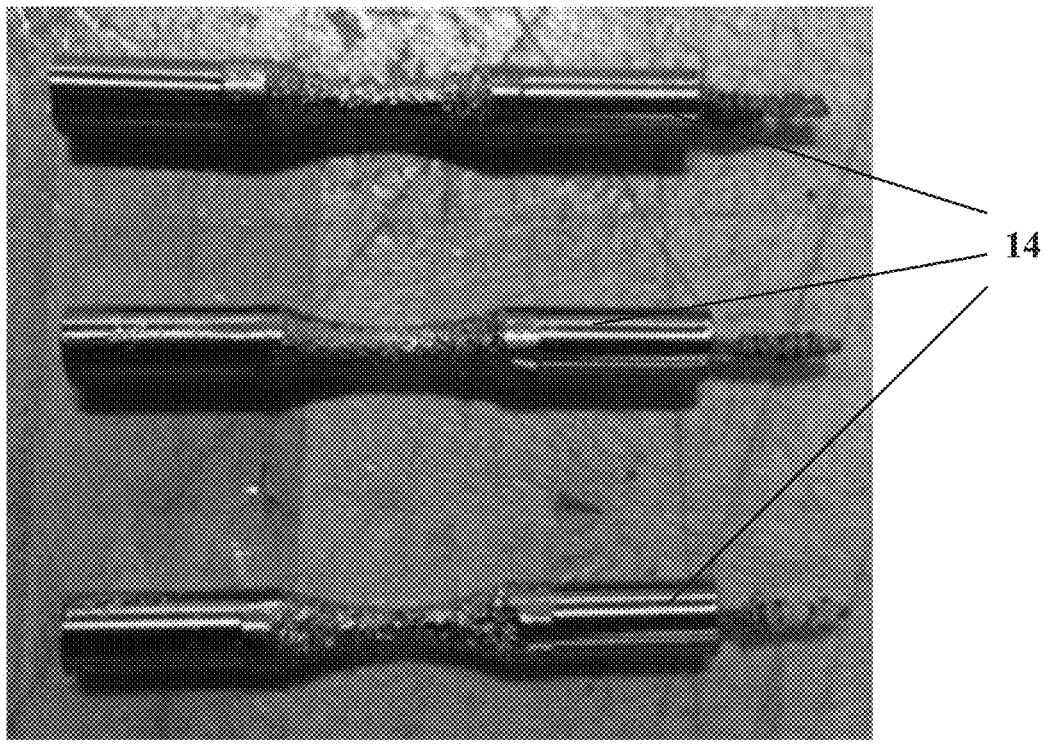
FIG. 42 is a photograph of workpieces that have been electropolished.
Figure 43:
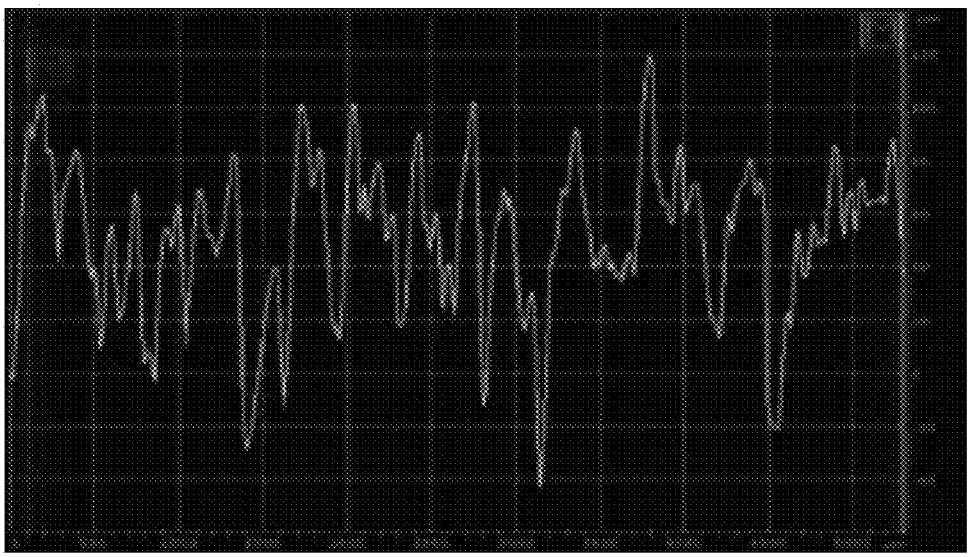
FIG. 43 is a profilometer readout of the as-received sample surface of the workpiece in FIGS. 40 and 41.

33-39. Additional workpieces 14 are shown in FIGS. 33, 34 and 36. FIGS. 35 and 37 show profilometer readouts of the as-received sample surface and polished workpieces 14 in FIGS. 34 and 36 respectively.

Figure 44:
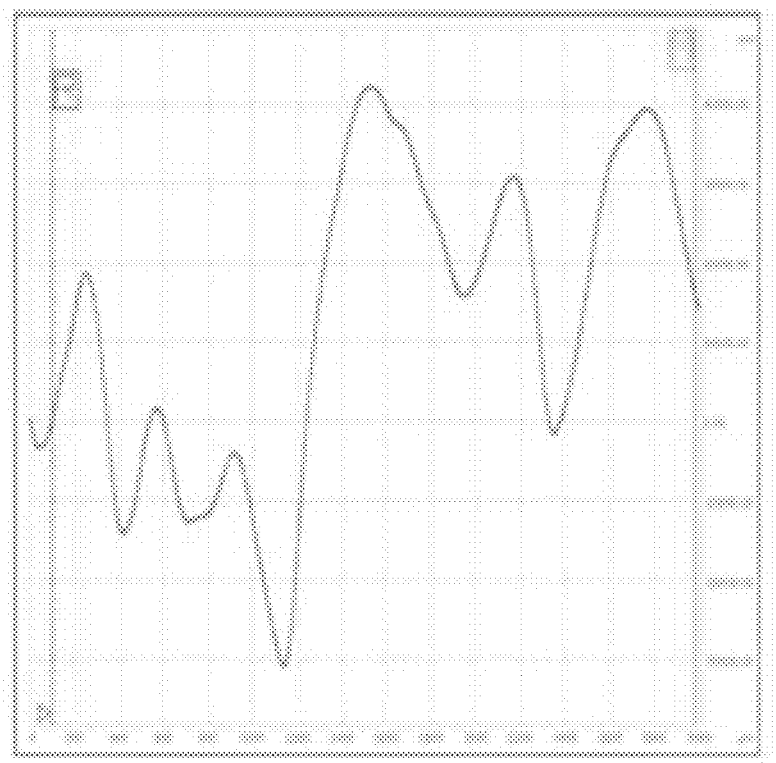
FIG. 44 is a readout of a sample surface after polishing 80V-80° F.
Figure 45:
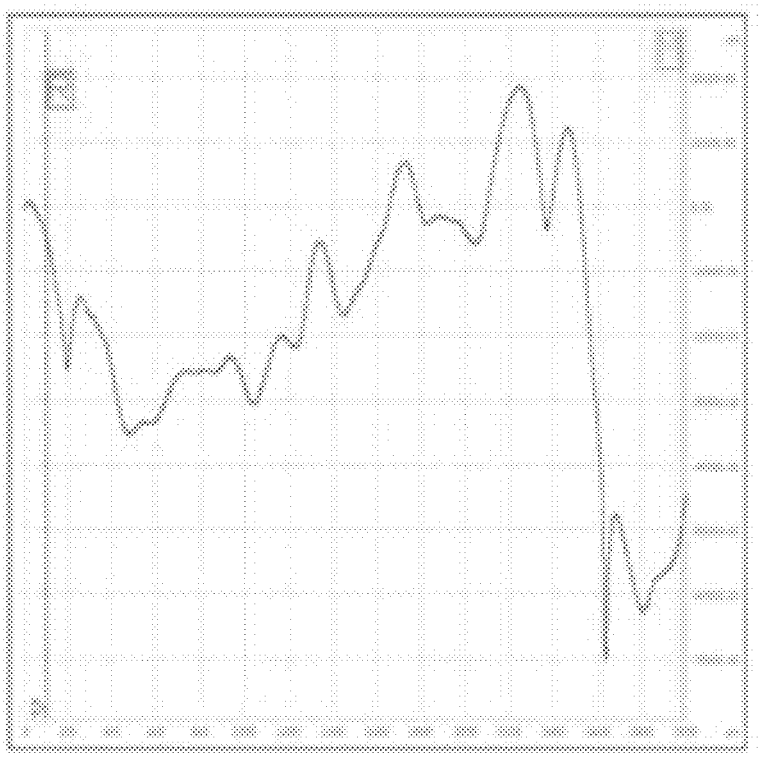
FIG. 45 is a readout of a sample surface after polishing 60V-100° F.
Figure 46:
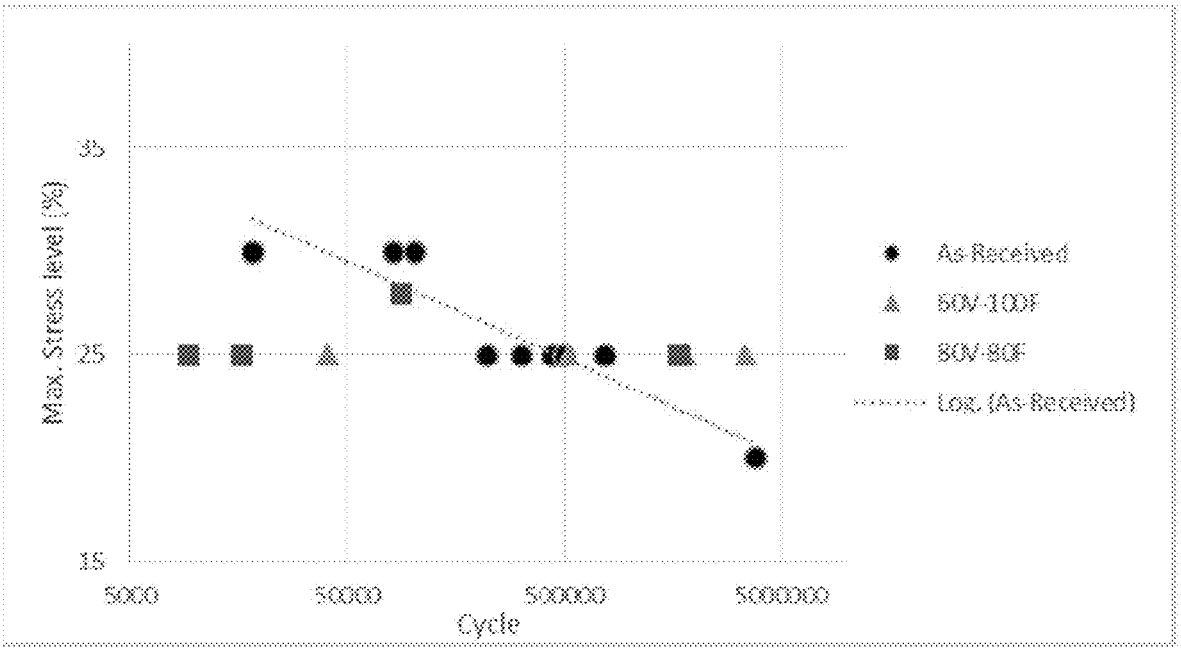
FIG. 46 is a plot of fatigue life, 80V-80F: Fatigue life>1,675,000; and 60V-100F: Fatigue life>3,396,000.
Figure 47:
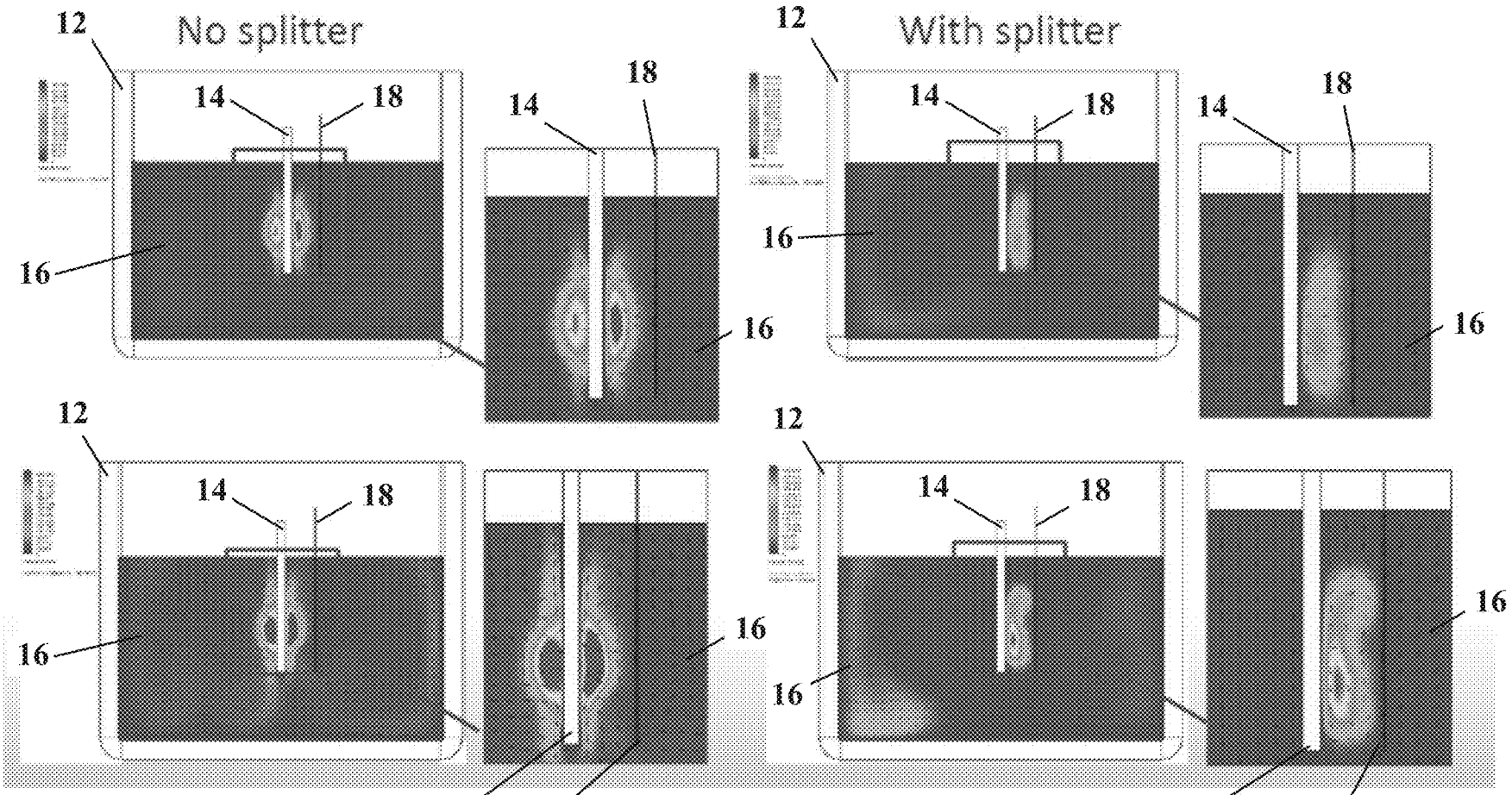
FIG. 47 is a schematic drawing illustrating electrolyte flow in container configurations with and without a splitter from a different than FIGS. 20-23.
Figure 48:
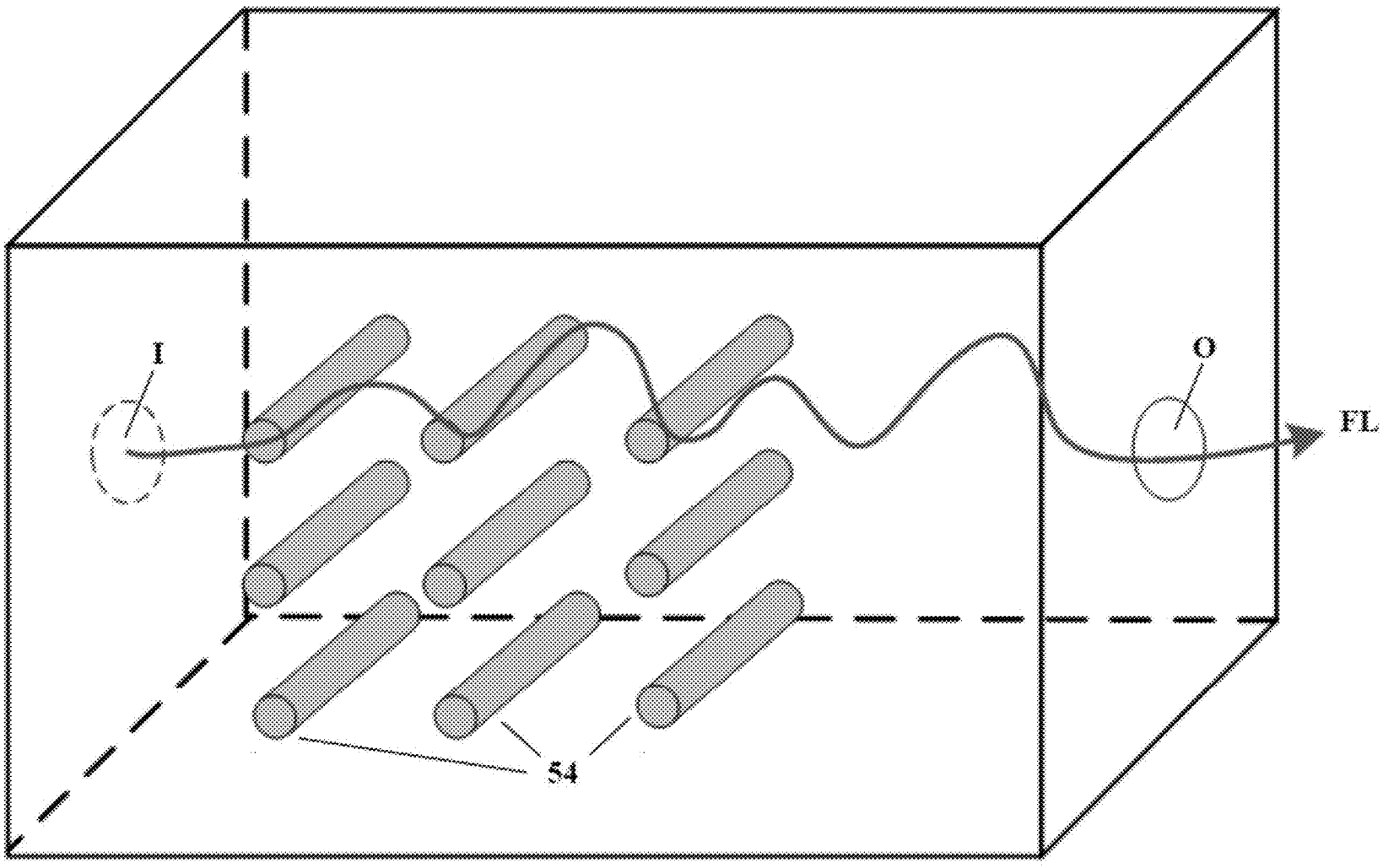
FIG. 48 is a schematic perspective view of a container of the presently disclosed subject matter including an ultrasonic acoustic array.
Figure 49:
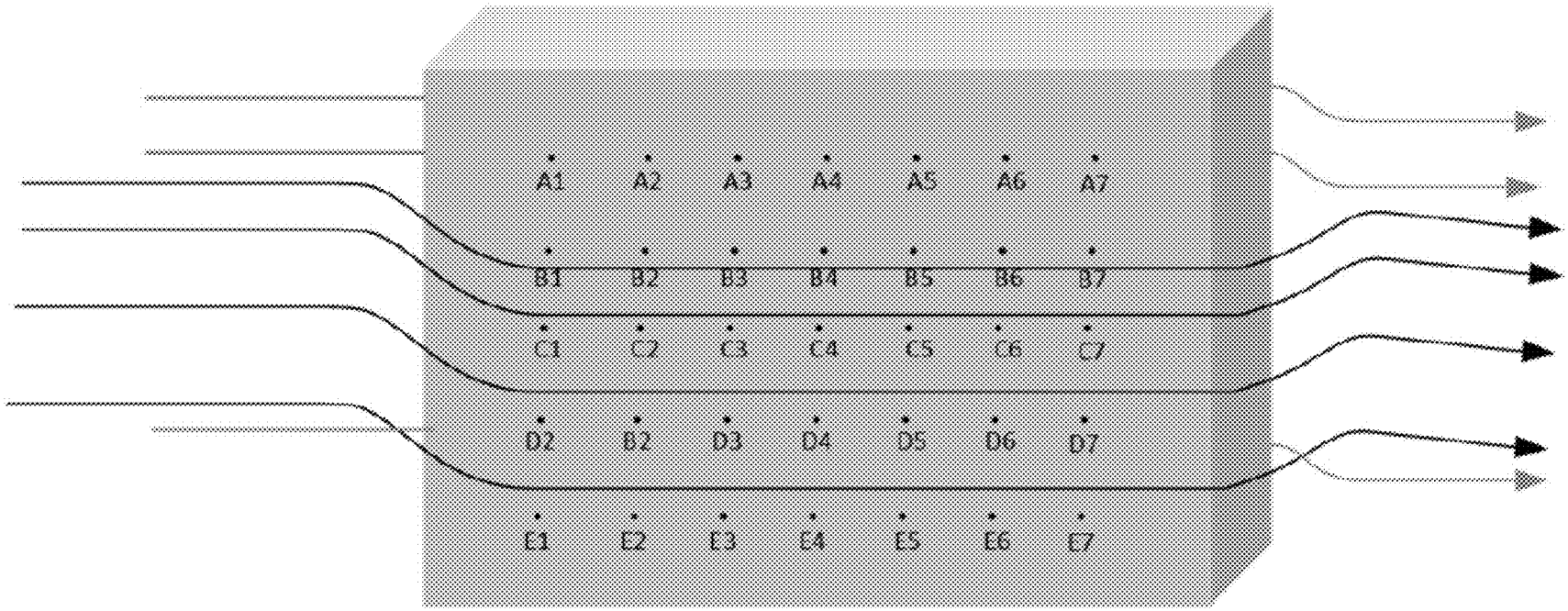
FIG. 49 is a schematic drawing illustrating multiple sample locations for flow rate simulation.
Figure 50:
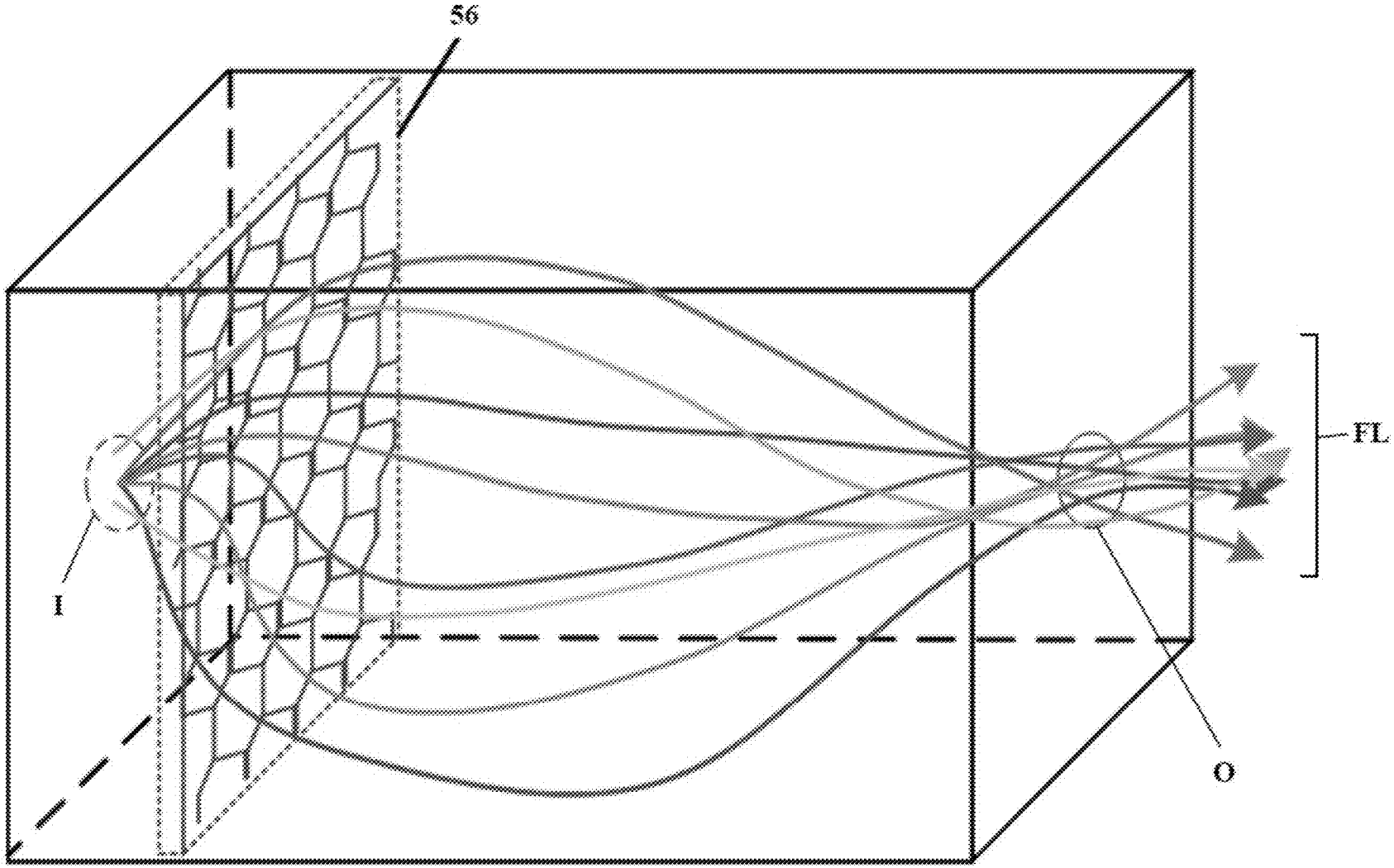
FIG. 50 is a schematic perspective view of a container of the presently disclosed subject matter including a flow filter.

Mechanical property enhancement was also evaluated. Modified fatigue testing samples fabricated on an Arcam EBM S400. 60V-100F (FIG. 45) and 80V-80F (FIG. 44) used for electropolishing. Workpieces 14 were circular, with about 45 mm in length with a diameter reduction in a medial position down to about 3 m. Workpieces 14 were rotated by 90°×4 times for consistency, overall polishing time 20 minutes. See FIGS. 40-45.

Tensile-tensile cyclic loading was tested. Ultimate static strength used as reference R=0.25 and R=0.30 determined based on crack initiation mode. Surface defect induced crack initiation for as received samples. Fatigue life (as-received) ~450,000. The test was stopped for some samples before failure 80V-80F: Fatigue life >1,675,000 60V-100F: Fatigue life >3,396,000. See FIG. 48.

Discussion of the Examples

The presently disclosed methods and systems are advantageous compared to the traditional non-solution based surface treatments such as mass finishing methods (e.g. vibratory tumbling), as the use of solution ensures that all exterior surfaces could be accessed for surface treatment. In addition, the combined utilization of chemical reaction and electrical potential allowed for enhanced process control that improves the uniformity of the surface treatment effects.

The presently disclosed methods and systems are also advantageous compared to the other solution-based surface treatment methods. Compared to an abrasive flow polishing method (Microtek Micro Machining Process—MMP), the presently disclosed methods and systems do not impose geometry limitations to the components, and also afford more isotropic surface treatment effects. Compared to the electropolishing method by Extrude Hone (available under the trademark COOLPULSE™), the presently disclosed methods and systems reduce and even eliminate the need of specialized electrodes, which can impose considerable geometrical limitations. In addition, other electropolishing based methods do not involve any control of the electrolyte flow, but instead aim to keep it consistent, whereas in some embodiments of the presently disclosed methods and systems the control of surface polishing effect is largely accomplished via the manipulation of the electrolyte flow.

REFERENCES

All references cited in the instant disclosure, including but not limited to all patents, patent applications, and publications thereof, scientific journal articles, and database entries, are incorporated herein by reference in their entireties to the extent that they supplement, explain, provide a background for, or teach methodology, techniques, and/or compositions employed herein.

[1] M. Blattmeier, G. Witt, J. Wortberg, J. Eggert, J. Toepker. Influence of surface characteristics on fatigue behaviour of laser sintered plastics. Rapid Prototyping Journal. 18(2012), 2:161-171.

[2] J. Vaithilingam, R. D. Goodridge, S. D. Christie, S. Edmondson, R. J. M. Hague. Surface modification of selective laser melted structures using self-assembled monolayers for biomedical applications. Polishing. Solid Freeform Fabrication Symposium, Austin, Tex., 2012.

[3] I. Yadroitsev, I. Smurov. Surface morphology in selective laser melting of metal powders. Physics Procedia. 12(2011): 264-270.

[4] J.-P. Kruth, J. Deckers, E. Yasa. Experimental investigation of laser surface remelting for the improvement of selective laser melting process. Solid Freeform Fabrication Symposium, Austin, Tex., 2008.

[5] J. A. Ramos, J. Murphy, K. Wood, D. L. Bourell, J. J. Beaman. Surface Roughness Enhancement of Indirect-SLS Metal Parts by Laser Surface Polishing. Solid Freeform Fabrication Symposium, Austin, Tex., 2001.

[6] A. B. Spiering, N. Herres, G. Levy. Influence of the particle size distribution on surface quality and mechanical properties in additive manufactured stainless steel parts. Solid Freeform Fabrication Symposium, Austin, Tex., 2010.

[7] B. Vasudevarao, D. P. Natarajan, M. Henderson, A. Razdan. Sensitivity of RP surface finish to process parameter variation. Solid Freeform Fabrication Symposium, Austin, Tex., 2000.

[8] A. Sachdeva, S. Singh, V. S. Sharma. Investigating surface roughness of parts produced by SLS process. International Journal of Advanced Manufacturing Technologies. 64(2013): 1505-1516.

[9] K. M. B. Taminger, R. A. hafley, D. T. Fhringer, R. E. Martin. Effect of surface treatment on electron beam freeform fabricated aluminum structures. Solid Freeform Fabrication Symposium, Austin, Tex., 2004.

[10] M. C. Frank, A. Joshi, D. D. Anderson, T. P. Thomas, M. J. Rudert, Y. Tochigi, J. L. Marsh, T. D. Brown. Patient-specific bone implants using subtractive rapid prototyping. Solid Freeform Fabrication Symposium, Austin, Tex., 2010.

[11] MiroTek Finishing. www.microtekfinishing.com.

[12] S. Rossi, F. Deflorian, F. Venturini. Improvement of surface finishing and corrosion resistance of prototypes produced by direct metal laser sintering. Journal of Materials Processing Technology. 148(2004): 301-309.

[13] M. Samoya, D. Cormier, O. Harrysson, O. Cansizoglu. Mechanical properties of chemically milled titanium lattice structures. Graduate Student Symposium, North Carolina State Univesity, 2009.

[14] T. P. Hoar, J. A. S. Mowat. Mechanism of electropolishing. Nature. 165(1950): 64-65.

[15] T. P. Hoar, D. C. Mears, G. P. Rothwell. The relationships between anodic passivity, brightening and pitting. Corrosion Science. 5(1965): 279-289.

[16] P. A. Jacquet. On the anodic behavior of copper in aqueous solutions of orthophosphoric acid. Journal of the Electrochemical Society. 69(1936): 629-655.

[17] Eric Mahe, Didier Devilliers. Surface modification of titanium substrates for the preparation of noble metal coated anodes. Electrochimica Acta. 46(2000): 629-636.

[18] Jukka Lausmaa, Bengt Kasemo, Hakan Mattsson, Hans Odelius. Multi-technique surface characterization of oxide films on electropolished and anodically oxidized titanium. Applied Surface Science. 45(1990): 189-200.

[19] O. Piotrowski, C. Madore, D. Landolt. The Mechanism of Electropolishing of Titanium in Methanol-Sulfuric Acid Electrolytes. Journal of The Electrochemical Society. 145(1998), 7:2362-2369.

[20] Joshua Pelleg. Electropolishing of Titanium. Metallography. 7(1974): 357-360.

[21] K. Tajima, M. Hironaka, K.-K. Chen, Y. Nagamatsu, H. Kakigawa, Y. Kozono. Electropolishing of CP titanium and its alloys in an alcoholic solution-based electrolyte. Dental Materials Journal. 27(2008), 2:258-265.

[22] M. Inman, E. J. Taylor, A. Lozano-Morales, L. Zardiackas. Electropolishing and Throughmask Electroetching of Nitinol Stents and Other materials in an Aqueous Electrolyte. Proceedings from the Materials & Processes for Medical Devices Conference 2011: Medical Device Materials VI. 2011: 31-36.

[23] M. S. Chandrasekar, Malathy Pushpavanam. Pulse and pulse reverse plating—Conceptual, advantages and applications. Electrochimica Acta. 53(2008): 3313-3322.

[24] J. B. Mathieu, D. Landolt. Electropolishing of Titanium in Perchloric Acid-Acetic Acid Solution. II. Polarization Behavior and Stoichiometry. Journal of The Electrochemical Society. 125(1978), 7: 1044-1049.

[25] Eric Mahe, Didier Devilliers. Surface modification of titanium substrates for the preparation of noble metal coated anodes. Electrochimica Acta. 46(2000): 629-636.

Chakradhar & Venu Gopal (2011) Multi-objective optimization of electrochemical machining of EN31 steel by grey relational analysis. International Journal of Modeling and Optimization 1.2:113.

Chinese Patent Document No. CN 101249577 B

Chinese Patent Document No. CN 107175376 A

Chinese Patent Document No. CN 107523856 A

Dehof et al. (2015) Evaluation of Electrochemical Machining Technology for Surface Improvements in Additive Manufactured Components. No. ORNL/TM-2015/384. Oak Ridge National Laboratory (ORNL), Oak Ridge, Tenn. (United States). Manufacturing Demonstration Facility (MDF).

extrudehone.com/coolpulse-technology-extrude-hone

Rao et al. (2008) Multi-objective optimization of electrochemical machining process parameters using a particle swarm optimization algorithm. Proceedings of the Institution of Mechanical Engineers, Part B: Journal of Engineering Manufacture 222.8:949-958.

U.S. Patent Application Publication No. 2010/0072077 A1

U.S. Pat. No. 4,851,090

U.S. Pat. No. 6,413,388 B1

U.S. Pat. No. 9,192,999 B2

U.S. Pat. No. 9,782,829 B2

It will be understood that various details of the presently disclosed subject matter can be changed without departing from the scope of the presently disclosed subject matter. Furthermore, the foregoing description is for the purpose of illustration only, and not for the purpose of limitation.

What is claimed is:

1. A process for treating a surface of a metal workpiece by electropolishing, the process comprising:

providing a metal workpiece produced by an additive manufacturing technique having a surface;

conducting a fluid flow simulation analysis for the metal workpiece surface whereby surface flow rate characteristics of the metal workpiece surface are estimated;

contacting the metal workpiece as an anode in a solution comprising electrolytes at a flow rate that varies according to a local shape of the metal workpiece surface;

providing a cathode in the solution;

producing an electrical field between the anode and the cathode within the solution to electropolish the metal workpiece surface wherein the solution is provided at a temperature;

and varying a fluid flow at the metal workpiece surface based on the fluid flow simulation to achieve different polishing rates to different areas of the metal workpiece surface.

2. The process of claim 1, wherein the temperature can be adjusted over a course of treatment or wherein the temperature is maintained constant over a course of treatment.

3. The process of claim 1, wherein a voltage of the electrical field is controlled by a DC power supply.

4. The process of claim 1, comprising providing the cathode and the anode at a predetermined distance apart.

5. The process of claim 4, comprising adjusting a location and/or rotational angle of the cathode and the anode.

6. The process of claim 5, comprising adjusting a location and/or rotational angle of the cathode and/or the anode through a linear and/or rotational motion control mechanism.

7. The process of claim 6, wherein the linear and/or rotational motion control mechanism comprises a stepper motor or a gear motor.

8. The process of claim 1, wherein electrolyte flow circulation is controlled by a liquid pump system.

9. The process of claim 1, comprising varying a location and/or a rotational angle of the workpiece numerous times or continuously during the process.

10. The process of claim 1, wherein the varying the fluid flow is achieved by an array of ultrasonic transducers installed on the sides of an electrolyte container containing the cathode, anode and electrolyte.

11. The process of claim 10, wherein the ultrasonic transducers introduce periodic vibration waveforms across the entire electrolyte fluid to achieve the different polishing rates at different areas of the metal workpiece surface.

* * * * *